US008055164B2

(12) United States Patent
Saito et al.

(10) Patent No.: US 8,055,164 B2
(45) Date of Patent: Nov. 8, 2011

(54) DEVELOPER STORAGE CASE HAVING A DISCHARGE OPENING OF A FLAT SHAPE

(75) Inventors: Kazuhiro Saito, Saitama (JP); Masanori Murase, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/963,042

(22) Filed: Dec. 8, 2010

(65) Prior Publication Data

US 2011/0076063 A1 Mar. 31, 2011

Related U.S. Application Data

(63) Continuation of application No. 11/949,831, filed on Dec. 4, 2007, now Pat. No. 7,873,308.

(30) Foreign Application Priority Data

May 15, 2007 (JP) ..... 2007-129343

(51) Int. Cl.
*G03G 15/08* (2006.01)

(52) U.S. Cl. ..... 399/263; 399/254; 399/256; 399/262

(58) Field of Classification Search ..... 399/258, 399/262, 263
See application file for complete search history.

(56) References Cited

U.S. PATENT DOCUMENTS 5,489,976 A 2/1996 Ichikawa
6,088,561 A 7/2000 Kawamura et al.
6,389,257 B1 5/2002 Harumoto et al.
2001/0038762 A1 11/2001 Ban et al.
2007/0258732 A1* 11/2007 Tanaka ..... 399/254

FOREIGN PATENT DOCUMENTS

CN 1054217 C 7/2000
CN 1309334 A 8/2001
JP 4-139469 A 5/1992
JP 7-287448 A 10/1995
JP 11-84846 A 3/1999

OTHER PUBLICATIONS

Chinese Office Action, dated Sep. 30, 2010 issued in counterpart application No. 200710301834.6.
Notice of Preliminary Rejection issued Oct. 14, 2010, in counterpart Korean Application No. 10-2008-0042239.

* cited by examiner

*Primary Examiner* — David Gray
*Assistant Examiner* — Andrew Do
(74) *Attorney, Agent, or Firm* — Sughrue Mion, PLLC

(57) ABSTRACT

A developer storage case includes: a storage case that includes a discharge opening formed in the horizontal direction side surface thereof, that is formed in a flat shape having a horizontal direction width larger than the vertical direction height thereof, and that stores a developer therein; a delivery member that has a center of rotation disposed shifted to the discharge opening, that is rotatably supported on one end wall of the storage case, and that delivers the developer stored within the storage case; and a drive transmission member that is supported on the end portion of the delivery member, and that drives and rotates the delivery member.

9 Claims, 27 Drawing Sheets

31h
31d
31q
31k
31r
31m
31s2
31s3
31t1
31t
31s
31s1
31x

XVIB
XVIC
XVID
XVIE
31a
31k
31j
31h
31r
31s2
31p
31u
31s
31m1
31m2
31m
31c1
31x

31h3
31s
31e
31w
31g
31f

XVIF
31n
31u
31s
31p
31v
31m
31k
31e
31n1
31x2
31x1
31x 31h
31j
31n
31r
31q
31s2
31s3
31t
31t1
31s
31s1
31u
31n1
31b
31x 31m
31n
31c1
31c
31k
31h
31x

DEVELOPER STORAGE CASE HAVING A DISCHARGE OPENING OF A FLAT SHAPE

CROSS-REFERENCE TO RELATED APPLICATIONS

This application is a continuation of application Ser. No. 11/949,831, filed Dec. 4, 2007, which is based on and claims priority under 35 U.S.C. 119 from Japanese Patent Application No. 2007-129343 filed May 15, 2007.

BACKGROUND

1. Technical Field

The present invention relates to a developer storage case and an image forming apparatus.

2. Related Art

Conventionally, in an image forming apparatus such as an electrophotographic type copying machine and a printer, a latent image formed on the surface of a sensitive member is developed by a developing device and the developed visible image is transferred and fixed to a medium to thereby form an image. In this type of image forming apparatus, in order to supply the developer that has been consumed in the image forming operation, there is widely employed a replaceable type developer storage case, that is, a so called toner cartridge.

SUMMARY (1) According to an aspect of the present invention, a developer storage case includes: a storage case that includes a discharge opening formed in the horizontal direction side surface thereof, that is formed in a flat shape having a horizontal direction width larger than the vertical direction height thereof, and that stores a developer therein; a delivery member that has a center of rotation disposed shifted to the discharge opening, that is rotatably supported on one end wall of the storage case, and that delivers the developer stored within the storage case; and a drive transmission member that is supported on the end portion of the delivery member, and that drives and rotates the delivery member.

BRIEF DESCRIPTION OF THE DRAWINGS

Exemplary embodiment of the present invention will be described in detail based on the following figures, wherein:

FIG. 5A is an explanatory view when viewed from obliquely behind and FIG. 5B is a view when viewed from the direction of the arrow mark VB shown in FIG. 5A;

FIG. 6A is an explanatory view when viewed from obliquely behind and FIG. 6B is a view when viewed from the direction of the arrow mark VIB shown in FIG. 6A;

FIG. 13A is a perspective view when viewed from right front obliquely above, FIG. 13B is a perspective view when viewed from left front obliquely below, FIG. 13C is a perspective view when viewed from left rear obliquely above, and FIG. 13D is a perspective view when viewed from right rear obliquely above;

FIG. 14A is a plan view, FIG. 14B is a view when viewed from the direction of the arrow mark XIVB shown in FIG. 14A, FIG. 14C is a section view taken along the XIVC-XIVC line shown in FIG. 14A, FIG. 14D is a section view taken along the XIVD-XIVD line shown in FIG. 14A, FIG. 14E is a section view taken along the XIVE-XIVE shown in FIG. 14A, and FIG. 14F is a section view taken along the XIVF-XIVF shown in FIG. 14B;

FIG. 16A is a plan view, FIG. 16B is a view taken from the direction of the arrow mark XVIB shown in FIG. 16A, FIG. 16C is a view taken from the direction of the arrow mark XVIC shown in FIG. 16A, FIG. 16D is a view taken from the direction of the arrow mark XVID shown in FIG. 16A, FIG. 16E is a view taken from the direction of the arrow mark XVIE shown in FIG. 16A, and FIG. 16F is a view taken from the direction of the arrow mark XVIF shown in FIG. 16E;

FIG. 17A is a perspective view when viewed from right front obliquely above, FIG. 17B is a perspective view when viewed from left front obliquely below, FIG. 17C is a perspective view when viewed from left rear obliquely below, and FIG. 17D is a perspective view when viewed from right rear obliquely above;

FIG. 18A is a plan view, FIG. 18B is a view taken from the direction of the arrow mark XVIIIB shown in FIG. 18A, FIG. 18C is a view taken from the direction of the arrow mark XVIIIC shown in FIG. 18A, FIG. 18D is a view taken from the direction of the arrow mark XVIIID shown in FIG. 18A, FIG. 18E is a view taken from the direction of the arrow mark XVIIIE shown in FIG. 18A, and FIG. 18F is a view taken from the direction of the arrow mark XVIIIF shown in FIG. 18E;

FIG. 19A is a perspective view when viewed from right front obliquely above, and FIG. 19B is a perspective view when viewed from right rear obliquely below;

FIG. 20A is a perspective view when viewed from right front obliquely below, FIG. 20B is a perspective view when viewed from right rear obliquely above, and FIG. 20C is a perspective view when viewed from left rear obliquely above;

FIG. 21A is a perspective view when viewed from right front obliquely above, FIG. 21B is a perspective view when viewed from left front obliquely below, FIG. 21C is a perspective view when viewed from left rear obliquely above, FIG. 21D is a perspective view when viewed from right rear obliquely above, FIG. 21E is a perspective view when viewed from front, FIG. 21F is a perspective view when viewed from the direction of the arrow mark XXIF shown in FIG. 21E, FIG. 21G is a perspective view when viewed from the direction of the arrow mark XXIG shown in FIG. 21E, FIG. 21H is a perspective view when viewed from the direction of the arrow mark XXIH shown in FIG. 21E, FIG. 21I is a perspective view when viewed from the direction of the arrow mark XXII shown in FIG. 21E, and FIG. 21J is a perspective view when viewed from the direction of the arrow mark XXIJ shown in FIG. 21I;

FIG. 22A is a perspective view when viewed from obliquely above, FIG. 22B is a perspective view when viewed from obliquely below, FIG. 22C is a plan view, FIG. 22D is a view when viewed from the direction of the arrow mark XXIID shown in FIG. 22C, FIG. 22E is a view when viewed from the direction of the arrow mark XXIIE shown in FIG. 22C, FIG. 22F is a view when viewed from the direction of the arrow mark XXIIF shown in FIG. 22C, FIG. 22G is a view when viewed from the direction of the arrow mark XXIIG shown in FIG. 22C, and FIG. 22H is a view when viewed from the direction of the arrow mark XXIIH shown in FIG. 22G;

FIG. 23A is a perspective view and FIG. 23B is a side view when viewed from the direction of the arrow mark XXIIIB shown in FIG. 23A;

FIG. 25A is a side view, FIG. 25B is a view when viewed from the direction of the arrow mark XXVB shown in FIG. 25A, FIG. 25C is a view when viewed from the direction of the arrow mark XXVC shown in FIG. 25A, FIG. 25D is a view when viewed from the direction of the arrow mark XXVD shown in FIG. 25A, FIG. 25E is a view when viewed from the direction of the arrow mark XXVE shown in FIG. 25A, FIG. 26A is an explanatory view to show the middle state of a step of mounting the toner cartridge into its associated cartridge storage case or removing the former from the latter, FIG. 26B is an explanatory view to show a state where the toner cartridge has been inserted into the deep portion of the cartridge storage case, FIG. 26C is an explanatory view to show a state where the cartridge storage case has been rotated inside and stored into the cartridge mounting portion, and FIG. 26D is an explanatory view to show a state where the toner cartridge has been moved forward from the state shown in FIG. 26C to its mounting position.

DETAILED DESCRIPTION

Figure 1:
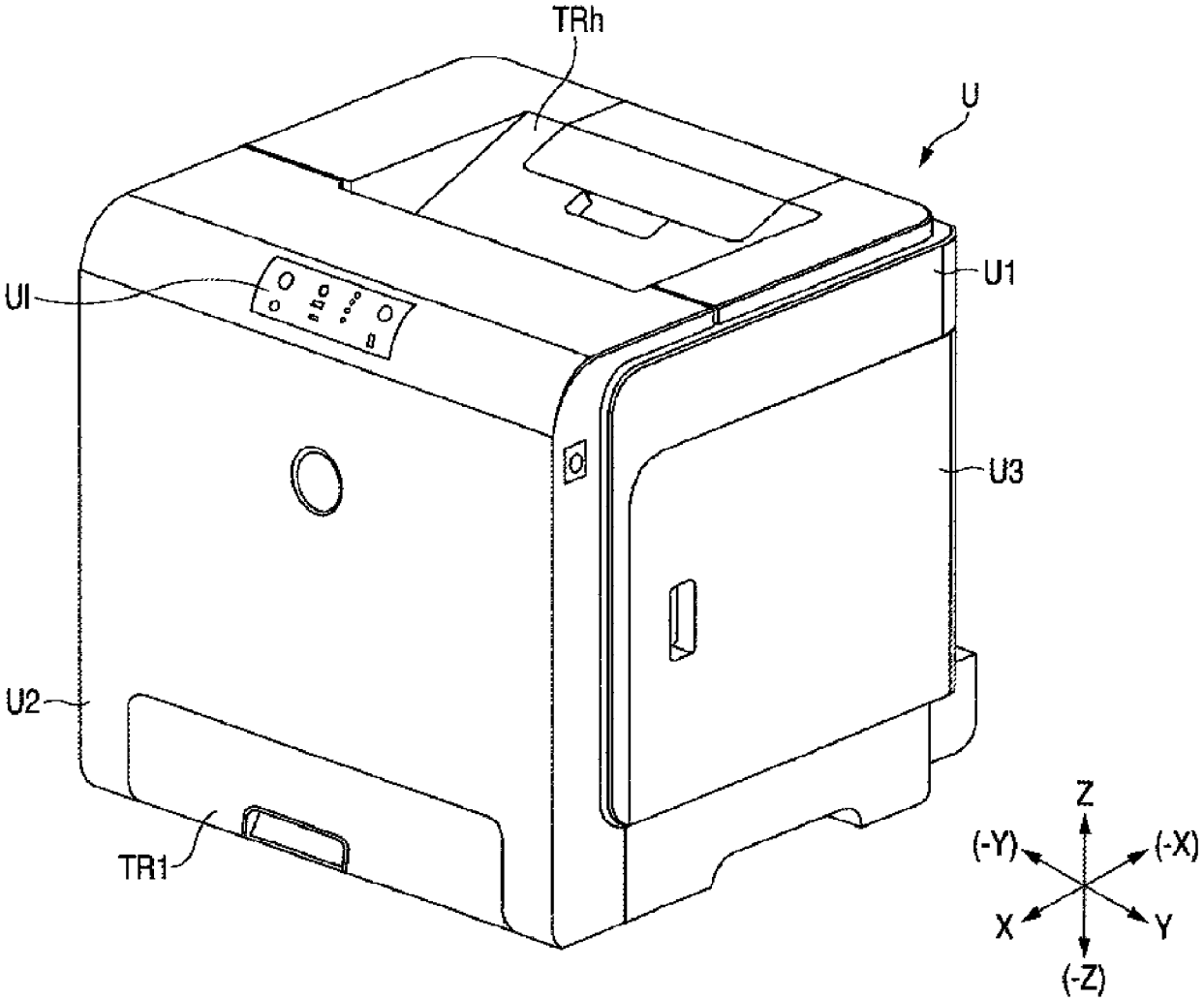
FIG. 1 is an explanatory perspective view of an image forming apparatus according to an exemplary embodiment 1 of the invention.

Now, description will be given below of a specific example of the mode for carrying out the invention (which is hereinafter referred to as an embodiment) with reference to the accompanying drawings. However, the invention is not limited to the following embodiment.

By the way, for easy understanding of the following description, in the drawings, a front and rear direction is expressed as an X axis direction, a left direction is expressed as a Y axis direction, and a vertical direction is expressed as a Z axis direction. Directions or sides, which are expressed by arrow marks X, −X, Y, −Y, Z, −Z respectively, are respectively used as a front direction, a rear direction, a right direction, a left direction, an upper direction, and a lower direction; or a front side, a rear side, a right side, a left side, an upper side and lower side.

Also, in the drawings, an expression, in which [•] is marked in [O], means an arrow mark which goes from the back of the figure sheet toward the front thereof; and, an expression, in which [x] is marked in [O], means an arrow mark going from the front of the figure sheet toward the back thereof.

Further, in the following description using the drawings, for easy understanding of the description, there are properly omitted other members than the members that are necessary for description.

Embodiment 1

FIG. 1 is an explanatory perspective view of an image forming apparatus according to an embodiment 1 of the invention.

Figure 2:
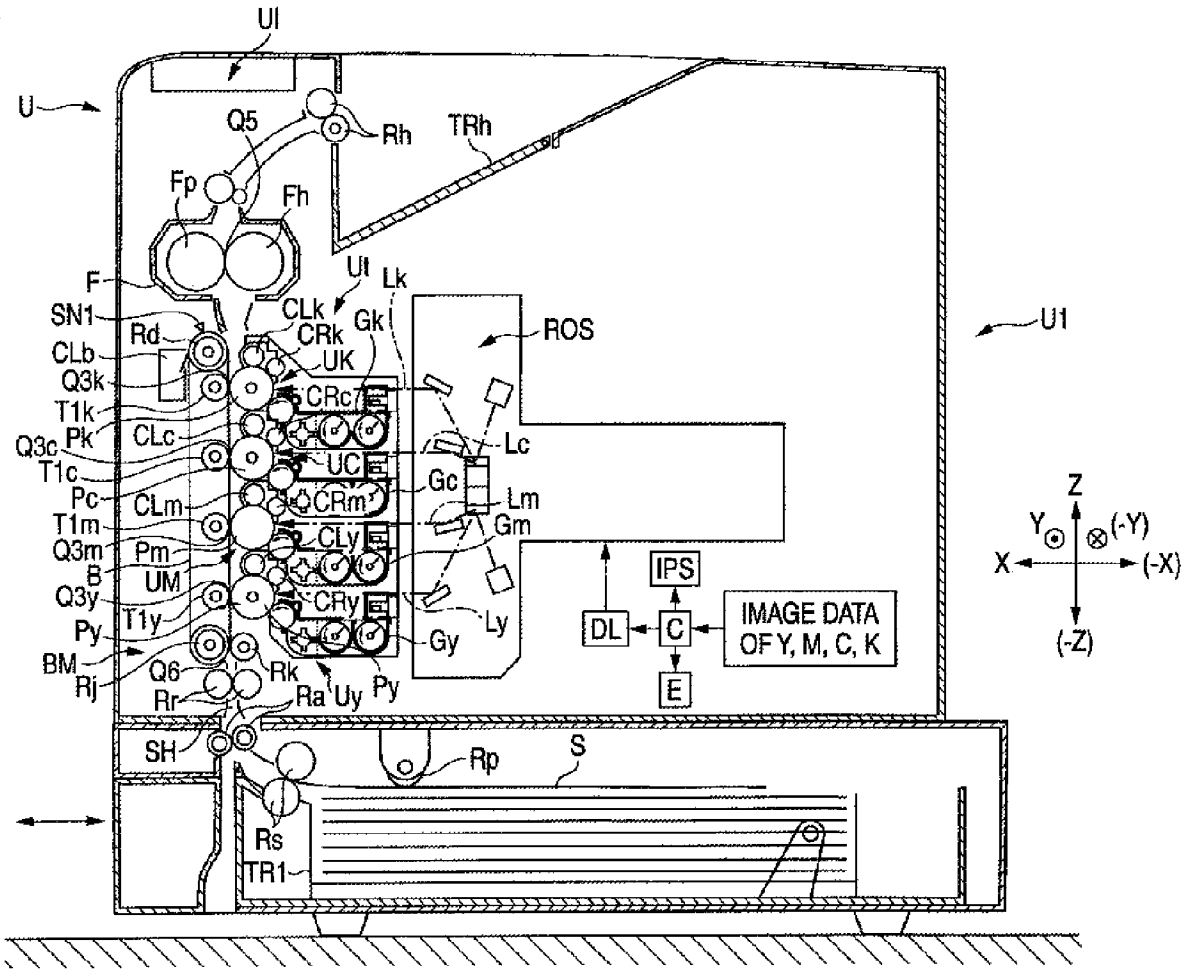
FIG. 2 is an explanatory view of the whole of the image forming apparatus according to the exemplary embodiment 1 of the invention.

FIG. 2 is an explanatory view of the whole of the image forming apparatus according to the embodiment 1 of the invention.

Figure 3:
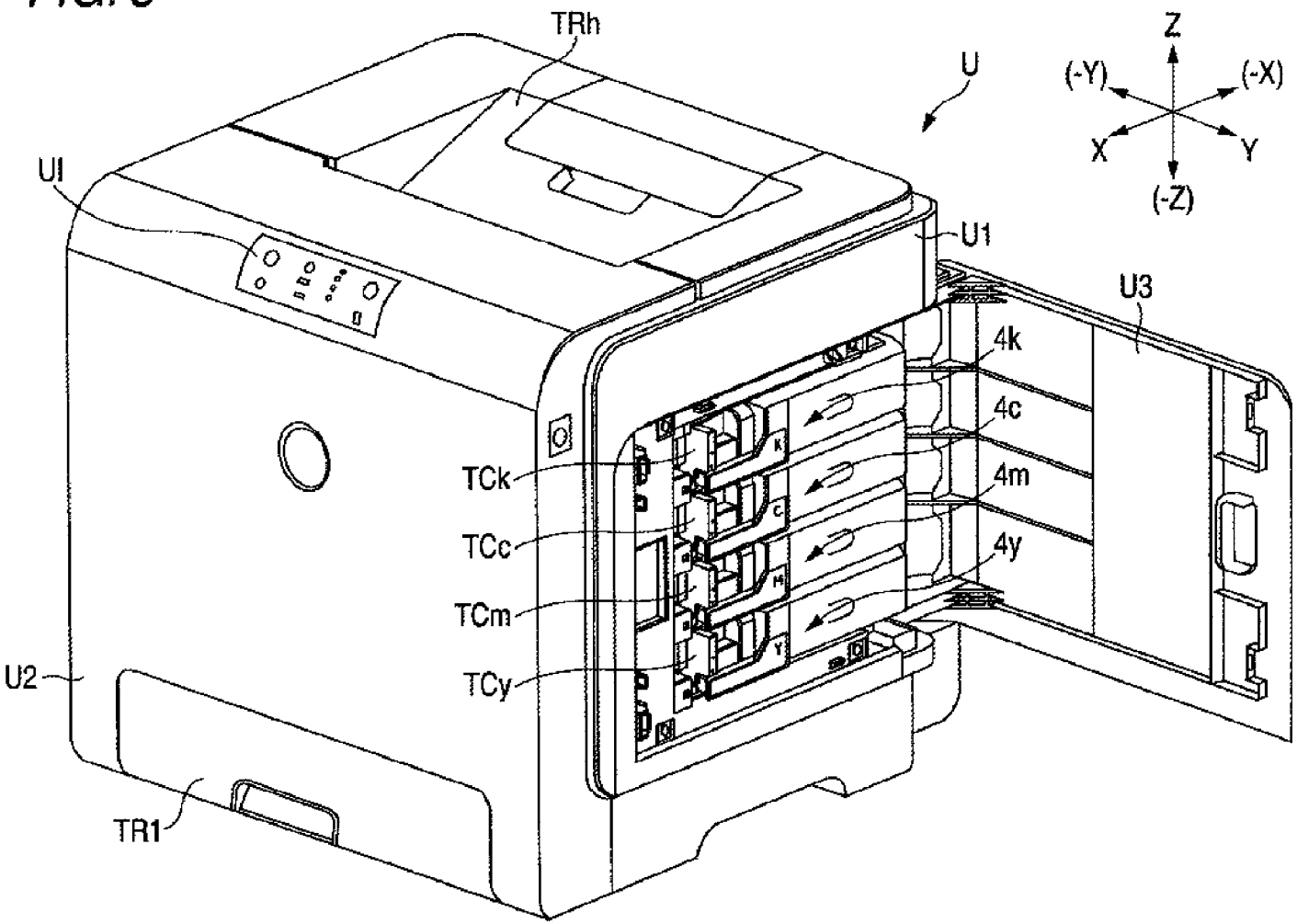
FIG. 3 is an explanatory perspective view of the image forming apparatus according to the exemplary embodiment 1 of the invention, showing a state in which a side cover is opened.

FIG. 3 is an explanatory perspective view of the image forming apparatus according to the embodiment 1 of the invention, showing a state in which a side cover is opened.

In FIGS. 1 to 3, a printer U, which is an example of the image forming apparatus according to the embodiment 1 of the invention, is structured such that a sheet feed case TR1 for storing therein a recording medium S used as an example of a medium for recording an image thereon is stored in the lower portion of the printer U; and, on the upper surface of the printer U, there is formed a sheet discharge portion TRh. Also, in the upper portion of the printer U, there is formed an operation portion UI which is used to carry out various operations such as a button input.

The Printer U according to the embodiment 1 includes an image forming apparatus main body U1, a front cover U2 as an example of an openable and closeable opening/closing portion disposed on the front side of the image forming apparatus main body U1, and a side cover U3 as an example of an openable and closeable opening/closing portion disposed on the side surface of the image forming apparatus main body U1. The front cover U2 is opened when opening the inside of the image forming apparatus main body U1 in order to replace, clean or maintain an image holder cartridge, a developing device and a wrong member or to remove a recording medium S clogged with sheets. And, the side cover U3 is opened when replacing a developer supply container, that is, a so called toner cartridge.

In FIG. 3, when the side cover U3 of the printer U is moved to its opening position, the side of the printer U is opened, so that toner cartridges TCy, TCm, TCc and TCk as an example of the developer storage container can be handled.

In FIG. 2, the printer U includes a control portion C for carrying out various controls of the printer U, an image processing portion IPS, an image write device drive circuit DL, a power supply device E and the like, the operations of which can be controlled by the control portion C. The power supply device E is used to apply a voltage to charging rollers CRy, CRm, CRc and CRk functioning as examples of a charging device (which will be discussed later), a developing roller as an example of a developer holder, transfer rollers T1*y*, T1*m*, T1*c* and T1*k* as examples of a transfer device, and the like.

The image processing portion IPS converts print information input from an external image information transmitter or the like to image information for forming latent images corresponding to images of four colors K (black), Y (yellow), M (magenta) and C (cyan), and outputs the latent image forming image information to the image write device drive circuit DL at a given timing. The image write device drive circuit DL, according to the input image information on the respective colors, outputs a drive signal to a latent image write device ROS. The latent image write device ROS, according to the drive signal, emits laser beams Ly, Lm, Lc and Lk as examples of image write lights for writing the respective color images.

In FIG. 2, in front of (in the +X direction) the latent image write device ROS, there are disposed visible image forming devices UY, UM, UC and UK which are used to form toner images as examples of the visible images of the respective colors Y (yellow), M (magenta), C (cyan) and K (black).

The K (black) visible image forming device UK includes a sensitive member Pk as an example of the image holder. In the periphery of the sensitive member Pk, there are arranged a charging roller CRk as an example of the charger, a developing device Gk for developing the electrostatic latent image on the surface of the sensitive member as a visible image, a sensitive member cleaner CLk as an example of an image holder cleaning device for removing a developer remaining on the surface of the sensitive member Pk, and the like.

After, in the charging area of the sensitive member Pk that is disposed opposed to the charging roller CRk, the surface of the sensitive member Pk is uniformly charged by the charging roller CRk, a latent image is written into the latent image forming area of the sensitive member Pk by the laser Lk. The thus written electrostatic image is converted to a visible image in the developing area that is disposed opposed to the developing device Gk.

The black visible image forming device UK according to the embodiment 1 includes a replaceable image holder cartridge, in which the sensitive member Pk and sensitive member cleaner CLk are formed as an integral body, and a replaceable developing cartridge composed of the developing device Gk.

The other remaining colors visible image forming devices UY, UM and UC as well, similarly to the black visible image forming device UK, respectively include an image holder cartridge and a developing cartridge both of which can be mounted onto and removed from the image forming apparatus main body U1. According to the embodiment 1, the four visible image forming devices UY, UM, UC and UK are respectively supported on a removably mountable frame body Ut, that is, a so called replacement frame Ut; and the four visible image forming devices UY, UM, UC and UK are structured such that they are integral with the image forming apparatus main body U1 and also they can be replaced respectively.

In FIG. 2, in front (in the +X direction) of the sensitive members Py to Pk, there is disposed a belt module BM as an example of a recording medium delivery device supported on the opening/closing portion U2. The belt module BM includes a medium delivery belt as an example of a recording medium hold and delivery member, a belt drive roller Rd as an example of a drive member for supporting the medium delivery belt B, a belt support roller (Rd+Rj) as an example of a hold and delivery member support system containing a driven roller Rj as an example of a driven member, transfer rollers T1*y*, T1*m*, T1*c* and T1*k* respectively as transfer devices disposed opposed to their associated sensitive members Py to Pk, a belt cleaner CLb as an example of a hold and delivery member cleaning device, and a medium attracting roller Rk as an example of a recording medium attracting member which is disposed opposed to the driven roller Rj and attracts the recording medium S to the medium delivery belt B. However, the medium attracting roller Rk is not always necessary but it can be omitted. The medium delivery belt B is rotatably supported by the belt support roller (Rd+Rj).

By the way, the image density sensor SN1 is used to detect the density of a density detecting image, namely, a so called patch image formed by image density adjust means (not shown) provided in the control portion C. The image density adjust means, according to the image density detected by the image density detect member, adjusts a voltage to be applied to the transfer rollers T1*y*, T1*m*, T1*c* and T1*k* and the intensity of the latent image write lights Ly, Lm, Lc and Lk to thereby adjust or correct the image density, that is, carry out a so called process control.

A recording medium S stored in the sheet feed case TR1 disposed downwardly of the medium delivery belt B is taken out by a sheet feed member Rp and is then delivered to a recording medium delivery passage SH.

The recording medium S in the recording medium delivery passage SH is delivered by a medium delivery roller Ra as an example of the recording medium delivery member and is sent to a resist roller Rr as an example of a sheet feed timing adjust member. The resist roller Rr delivers the recording medium S at a given timing to a recording medium attracting position Q6 which is set opposed to a driven roller Rj and medium attracting roller Rk. The recording medium S, which has been delivered to the recording medium attracting position Q6, is then attracted electrostatically to the medium delivery belt B.

The recording medium S, which has been attracted to the medium delivery belt B, is allowed to move sequentially through the transfer areas Q3*y*, Q3*m*, Q3*c* and Q3*k* which are in contact with the sensitive members Py, Pm, Pc and Pk respectively.

To the transfer rollers T1*y*, T1*m*, T1*c* and T1*k* which are disposed on the back surface side of the medium delivery belt B in the transfer areas Q3*y*, Q3*m*, Q3*c* and Q3*k*, at a given timing, there is applied a transfer voltage having a reversed polarity with respect to the charged polarity of the toner from the power supply circuit E which is controlled by the control portion C.

For a multiple color image, the toner images on the respective sensitive members Py, Pm, Pc and Pk are superimposingly transferred to the recording medium S on the medium delivery belt B by their associated transfer rollers T1*y*, T1*m*, T1*c* and T1*k*. Also, for a single color image, that is, for a monochrome image, only the K (black) toner image is formed on the sensitive member Pk and only this K (black) toner image is transferred to the recording medium S by the transfer device T1*k*.

After the toner images are transferred, the toner remaining on the surfaces of the sensitive members Py, Pm, Pc and Pk is collected and cleaned by their associated sensitive member cleaners Cly to Clk, and the sensitive members Py, Pm, Pc and Pk are charged again by their associated charging rollers CRy to CRk.

The recording medium S with the toner images transferred thereto is fixed in a fixing area Q5 which can be defined by pressure contact between a heating roller Fh as an example of a heating and fixing member provided in a fixing device F functioning as an example of a fixing device and a pressure roller Fp as an example of a pressure fixing member. The recording medium S with the images fixed thereon is then discharged from a discharge roller Rh, which is used as an example of a medium discharge roller, to a medium discharge portion TRh.

The medium delivery belt B, after the recording medium S is removed therefrom, is cleaned by the belt cleaner Clb.

(Description of Developer Delivery Device)

Figure 4:
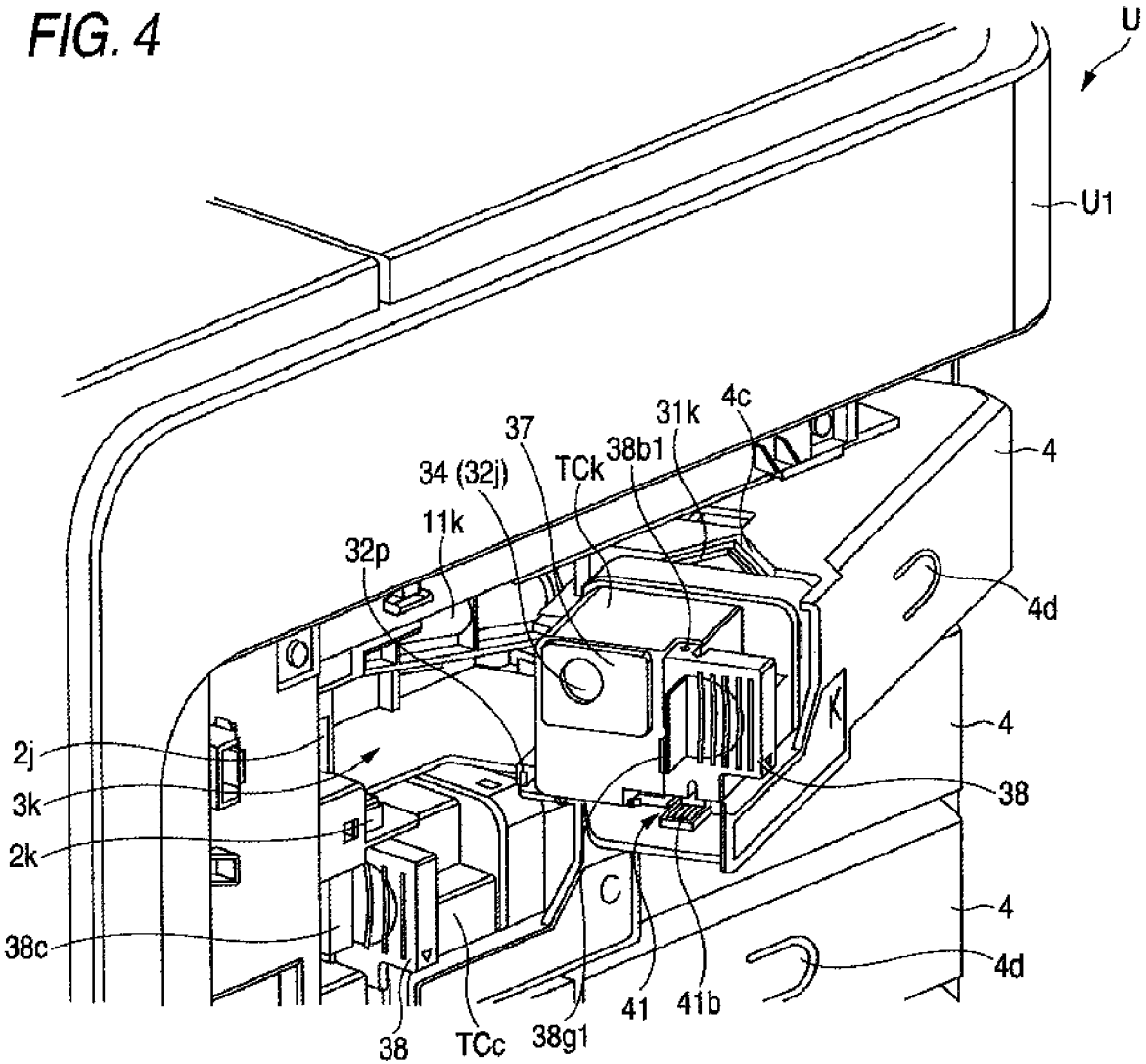
FIG. 4 is an explanatory view of a portion of the image forming apparatus, showing a state in which a toner cartridge as an exemplary example of a developer storage case is mounted and removed.

FIG. 4 is an explanatory view of a state in which a toner cartridge as an example of the developer storage case is mounted onto and removed from the image forming apparatus main body.

Figure 5B:
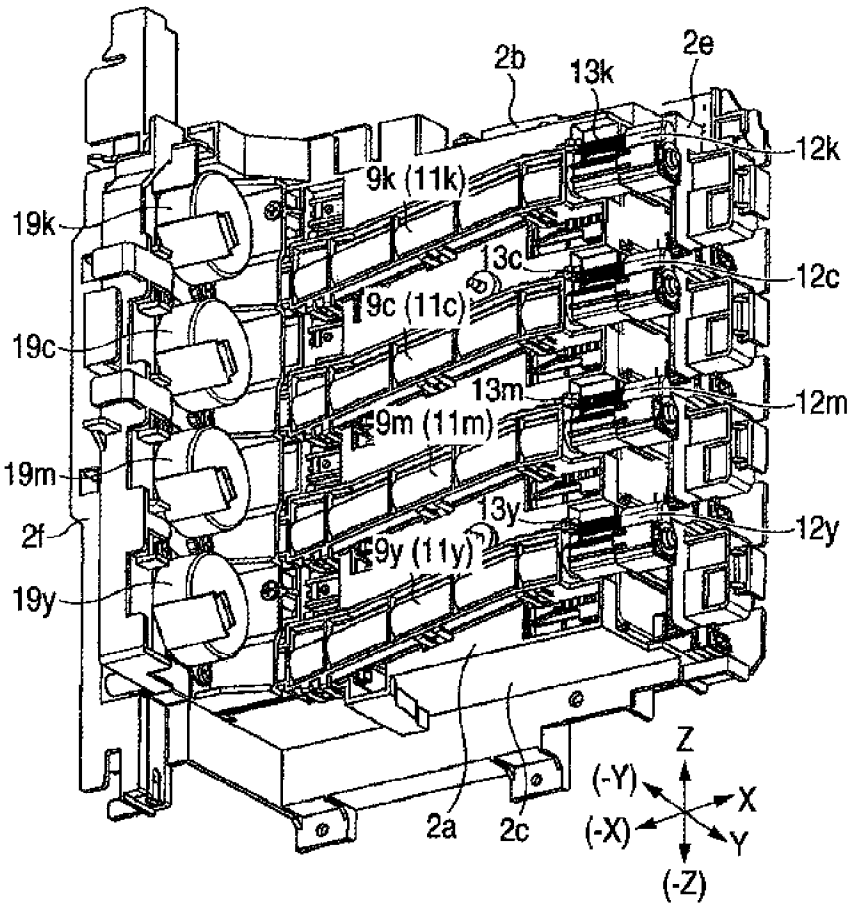
FIGS. 5A and 5B are explanatory views of a developer delivery device according to the exemplary embodiment 1, showing a state in which the toner cartridge is mounted, specifically.
Figure 5A:
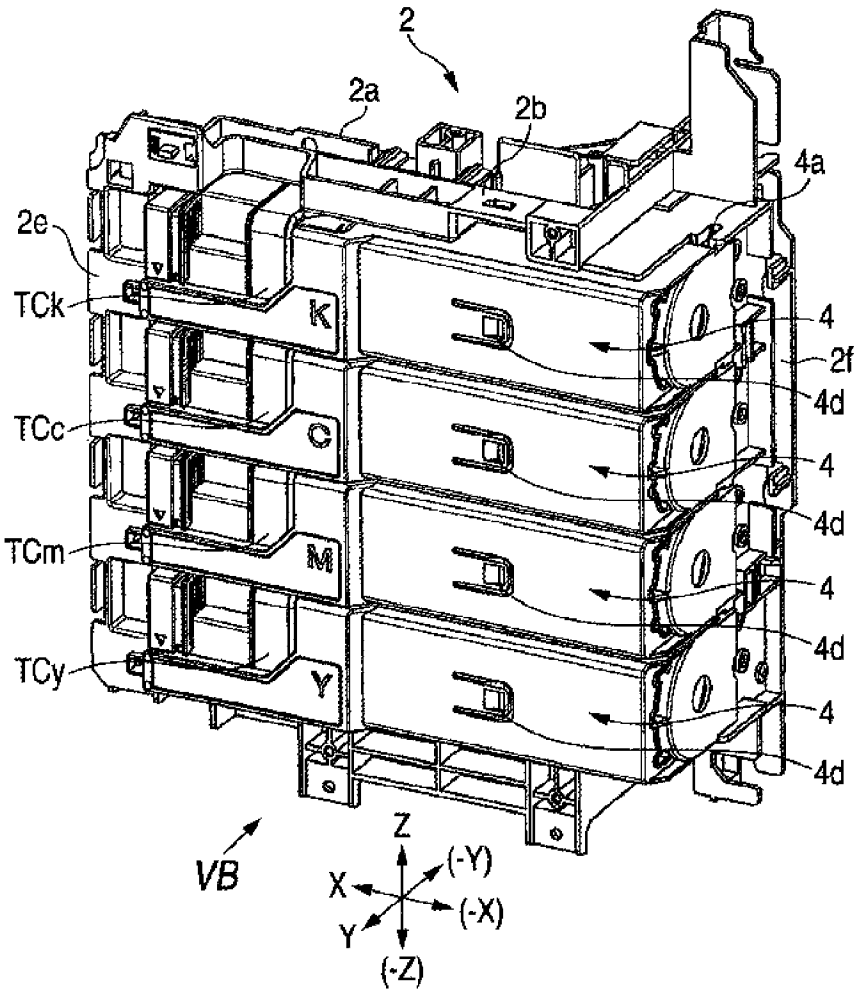

FIG. 5 is an explanatory view of a developer delivery device according to the embodiment 1 of the invention in a state where the toner cartridge is mounted on the image forming apparatus main body. Specifically, FIG. 5A is an explanatory view of the developer delivery device, showing a state where the developer delivery device is viewed from obliquely backward thereof, and FIG. 5B is a view of the developer delivery device when it is viewed from the direction of the arrow mark VB shown in FIG. 5A.

Figure 6B:
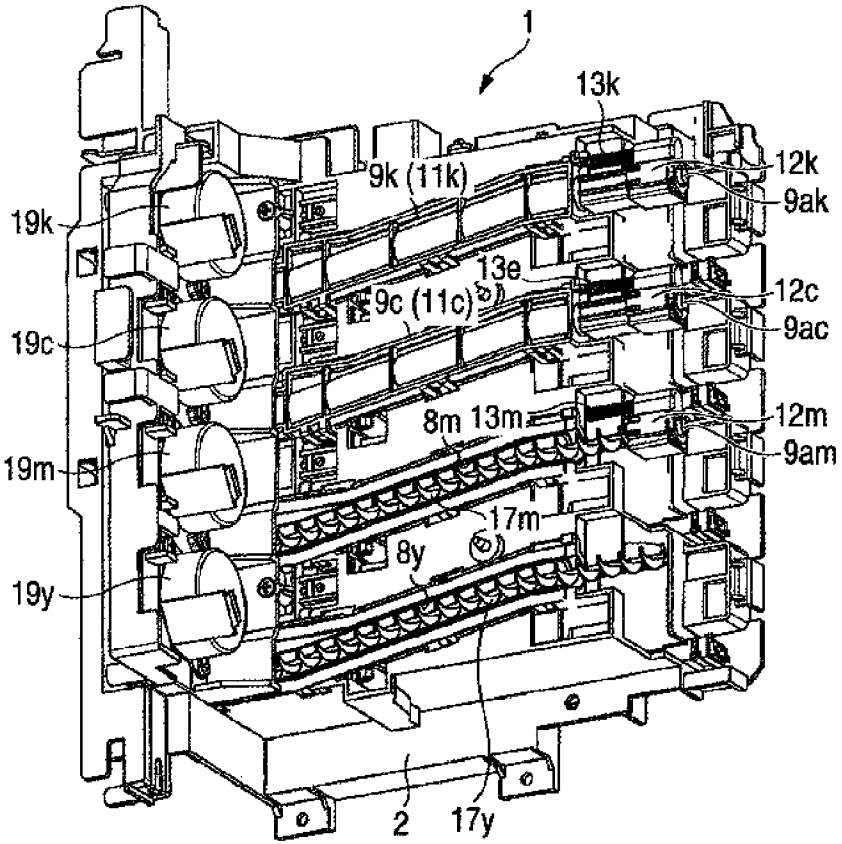
FIGS. 6A and 6B are explanatory views of the developer delivery device, showing a state in which the toner cartridge and some other members are removed from the state shown in FIG. 5, specifically.
Figure 6A:
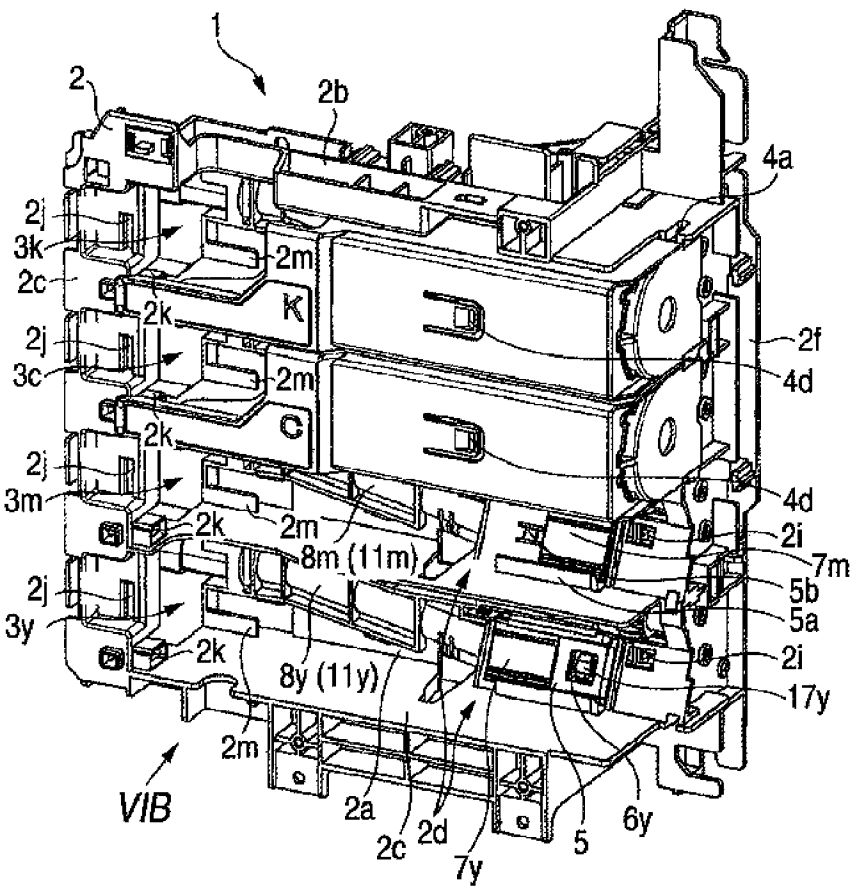

FIG. 6 is an explanatory view of the developer delivery device, showing a state where the toner cartridge is removed from the state shown in FIG. 5 and some of the members thereof are also removed. Specifically, FIG. 6A is an explanatory view of the developer delivery device, showing a state where it is viewed from obliquely backward; and, FIG. 6B is a view of the developer delivery device when it is viewed from the direction of the arrow mark VIB shown in FIG. 6A.

Figure 7:
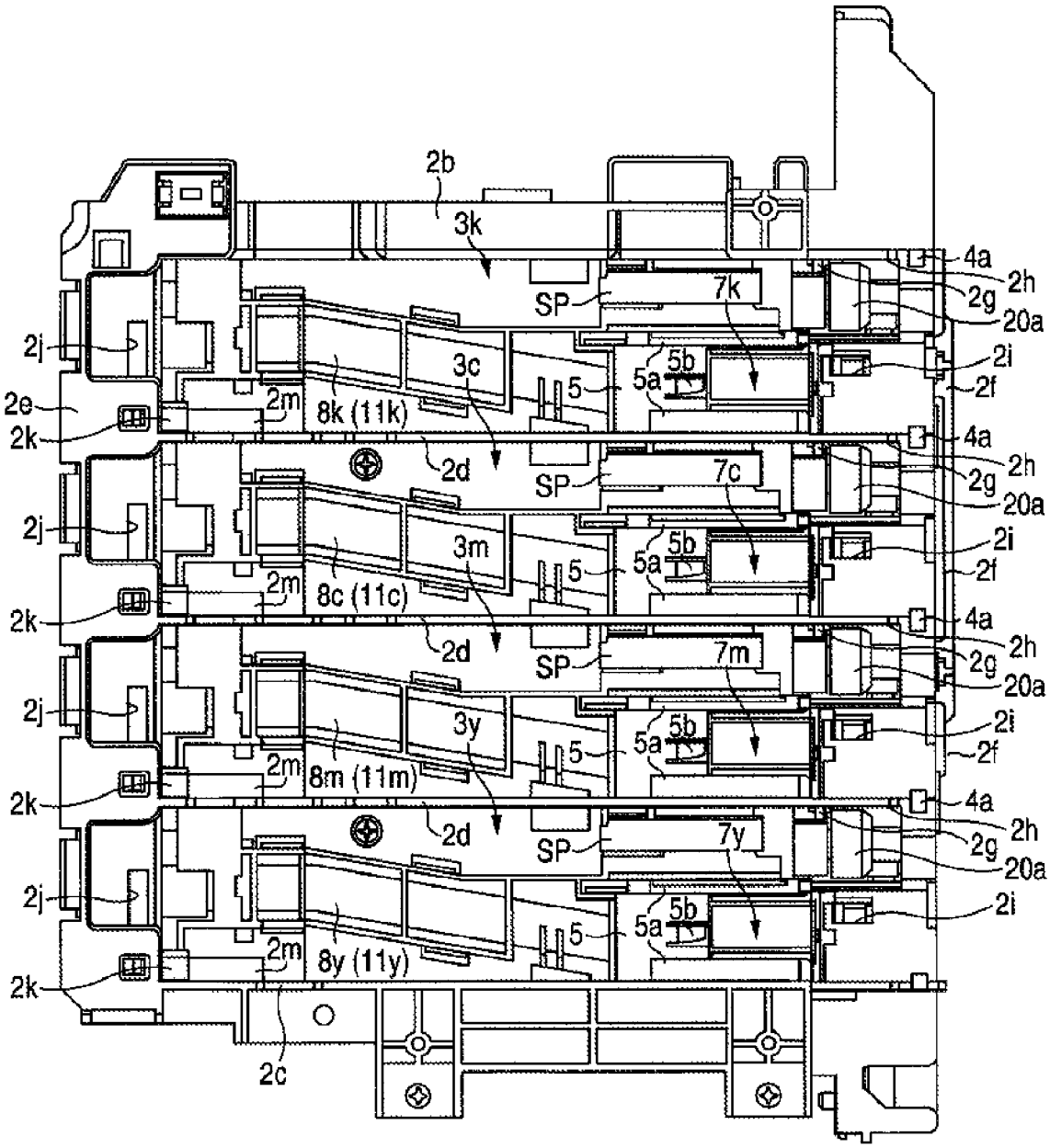
FIG. 7 is a side view of the developer delivery device according to the exemplary embodiment 1.

FIG. 7 is a side view of the developer delivery device according to the embodiment 1.

Figure 8:
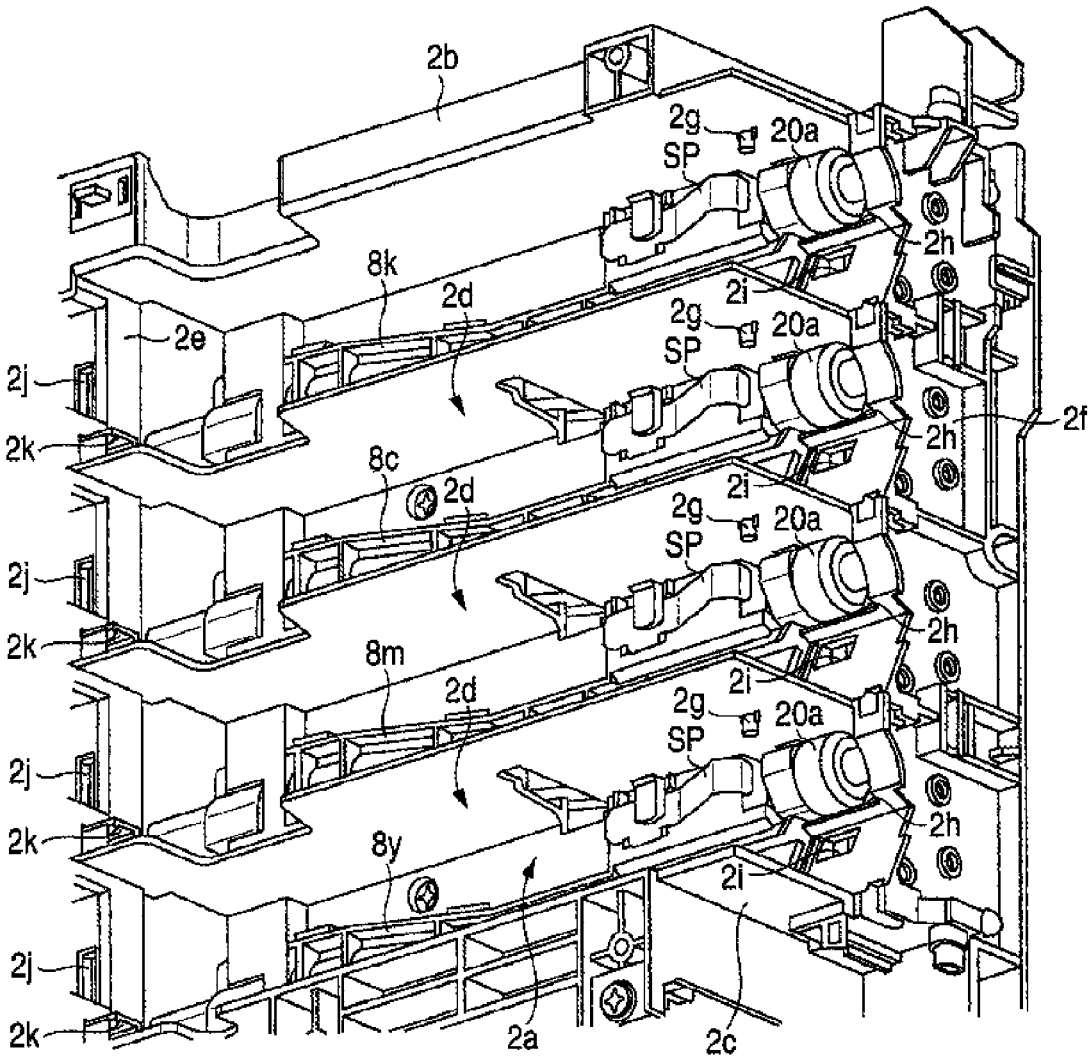
FIG. 8 is an explanatory view of the developer delivery device according to the exemplary embodiment 1 when viewed from obliquely below.

FIG. 8 is an explanatory view of the developer delivery device according to the embodiment 1 when it is viewed from obliquely backward thereof.

Figure 9:
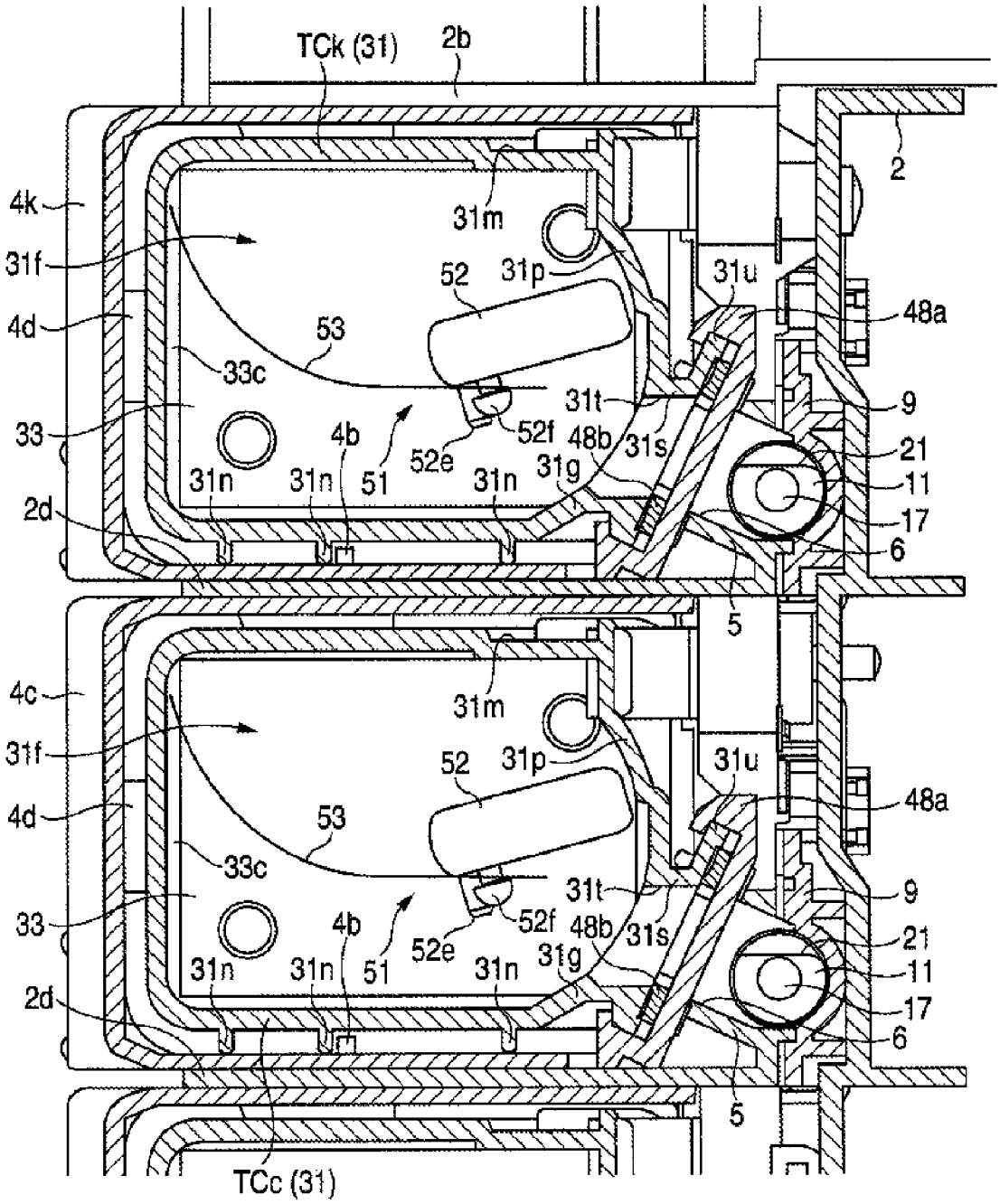
FIG. 9 is an explanatory section view of the main portions of a flow-out opening portion of the developer delivery device in a state where the toner cartridge is inserted and a shutter is not opened.

FIG. 9 is an explanatory view of the main portions of the flow-out opening portion of the developer delivery device, showing a state where a toner cartridge is inserted and a shutter is not opened.

By the way, in the following description, members respectively provided for the respective colors Y, M, C and K are similar in structure to each other and thus, in principle, they will be described while their respective suffixes are omitted.

In FIGS. 4 to 8, to the right interior portion of the image forming apparatus main body U1, there is fixed and supported a developer delivery device 1. The developer delivery device 1 includes a frame body 2. The frame body 2 includes a plate-shaped frame body main body 2*a* extending in the vertical direction, a top wall portion 2*b* provided on and projected from the upper end of the frame body main body 2*a* in the right direction, and a bottom wall portion 2*c*. Between the top wall portion 2*b* and bottom wall portion 2*c*, there are formed three partition wall portions 2*d* which are respectively arranged parallel to the top wall portion 2*b* and bottom wall portion 2*c*. In the front and rear ends of the frame body main body 2*a*, there are formed a front end wall portion 2*e* and a rear end wall portion 2*f* respectively.

In FIGS. 7 and 8, in the lower surfaces of the front end wall portion 2*b* and partition wall portion 2*d*, there are formed rotation regulate portions 2*g* which respectively project in the lower direction. In the portions of the frame body main body 2*a* that are situated downward of the rotation regulate portions 2*g*, there are formed drive transmission member openings 2*h* respectively. Downwardly of the drive transmission member openings 2*h*, there are formed angular-hole shaped cartridge shutter fix portions 2*i* as an example of a container side opening/closing member fix portion.

In FIGS. 7 and 8, on the front side of the respective drive transmission member openings 2*h*, there are supported plate springs SP which respectively extend to the outside (to the right side).

In FIGS. 4 and 6A, in the front wall portion 2*e*, there are formed lock portions 2*j* as examples of a fixing portion and, downwardly of the respective lock portions 2*j*, there are formed CRUM connector portions 2*k* as examples of a memory member connecting portion which project backward. In FIG. 6A, in the portions of the frame body main body 2*a* that are respectively situated backwardly of the CRUM connector portions 2*k*, as an example of a front side guide portion, there are formed plate-shaped front side guide portions 2*m*.

By spaces which are respectively sandwiched by the top wall portion 2*a*, partition wall portions 2*d* and bottom wall portion 2*c* of the frame body 2, there are formed four cartridge mounting portion 3 on which toner cartridges TCy, TCm, TCc and TCk for Y, M, C and K can be mounted respectively in this order from bottom.

On the cartridge mounting portions 3, respectively, there are supported cartridge storage cases 4 into which the toner cartridges TCy, TCm, TCc and TCk can be stored (in FIG. 6A, there are shown only the C color and K color but Y color and M color are not shown) in such a manner that they can be rotated about their associated rotation center portions 4*a* formed in the rear ends thereof. In FIG. 9, in the bottom portions of the cartridge storage cases 4, as an example of a guide portion, there are arranged guide ribs 4*b* which not only are provided on and projected from their associated storage case bottom portions upwardly but also extend in the back and forth direction. In FIG. 4, in the upper surfaces of the front end portions of the cartridge storage cases 4, as an example of a mounting time positioning portion, there are formed positioning cut-away portions 4*c* which respectively have an isosceles triangle shape. In FIGS. 4 to 6, in the right end walls of the cartridge storage cases 4, there are formed mounting sense operation portions 4*d* which not only are formed in a shape allowing them to extend into the inside of their associated walls but also can be elastically deformed.

In FIG. 6, in the rear end portions of the respective cartridge mounting portions 3 of the frame body 2, there are formed flow-in opening forming portions 5 respectively having flow-in openings 6 into which developers from the toner cartridges TCy, TCm, TCc and TCk are allowed to flow (in FIG. 6A, there is shown only the Y developer). In each flow-in opening forming portion 5, there is formed a pair of upper and lower shutter guide portions 5*a* which extends in the back and forth direction as an example of a guide member. Also, in FIGS. 6A and 7, in the flow-in opening forming portion 5, as an example of a closing member securing portion, there is formed a shutter lock portion 5*b* which slants outwardly (to the right) and can be elastically deformed (in FIG. 6A, only the M color is shown).

On the shutter guide portion 5*a* of each flow-in opening forming portion 5, there is supported, as an example of a flow-in opening closing member, a main body side shutter 7 in such a manner that it can be moved in the back and forth direction. The main body side shutter 7 is supported to be movable between an open position shown in the Y color main body side shutter 7 in FIG. 6A where the flow-in opening 6 is opened and a closed position shown in the M color main body side shutter 7 in FIG. 7 and FIG. 6A where the flow-in opening 6 is closed. By the way, the front end face of the main body side shutter 7 is contacted with the shutter lock portion 5*b* which project outside and can be elastically deformed, whereby the main body side shutter 7 is prevented against movement, that is, it is locked at the closed position.

Figure 10:
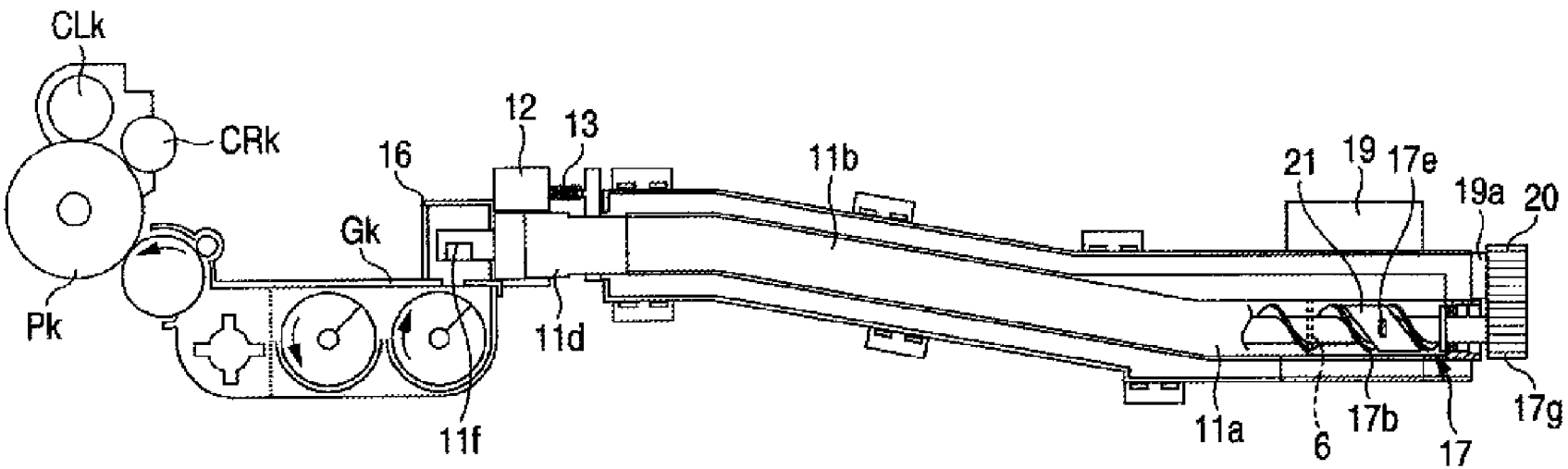
FIG. 10 is an explanatory view of the relationship between the developer delivery device and developing device according to the exemplary embodiment 1 of the invention.

FIG. 10 is an explanatory view of the relationship between the developer delivery device and developing device according to the embodiment 1 of the invention.

In FIG. 6B, in the inner surface of the frame body main body 2*a* of the frame body 2, there is formed a main body side delivery passage forming recessed portion 8 which extends forward from the flow-in opening 6 and is recessed outward. In FIGS. 4 to 8, on the inner surfaces of the frame body 2, there are mounted delivery passage forming members 9 (in FIG. 6B, there are shown only the C and K colors) in such a manner that they respectively correspond to their associated main body side delivery passage forming recessed portions 8. An internal cylindrical-shaped space, which is defined by each main body side delivery passage forming recessed portion 8 and its associated delivery passage forming member 9, constitutes a developer delivery passage 11.

In FIG. 10, the developer delivery passages 11 respectively extend from the positions of the flow-in openings 6 to the developing devices Gy, Gm, Gc and Gk. According to the embodiment 1, each developer delivery passage 11 is formed not in a linear shape but in a curved shape which has a flow-in side horizontal delivery portion 11*a* extending horizontally from its associated flow-in opening 6, a slanting delivery portion 11*b* slanting obliquely upward from the flow-in side horizontal delivery portion 11*a*, and a developing side horizontal delivery portion 11*d* extending horizontally from the slanting delivery portion 11*b* to its associated developing device Gk (devices Gy, Gm, Gc and Gk).

In FIGS. 5B, 6B and 10, on the front end side of the delivery passage forming member 9, there is formed a developing device connecting portion 9*a* which constitutes the developing side horizontal delivery portion 11*d*; and, on the developing device connecting portion 9*a*, there is mounted a flow-out opening shutter 12 as an example of a flow-out opening closing member. The flow-out opening shutter 12 is always energized to a front closing position by a spring 13 as an example of an energizing member to thereby close the flow-out opening 11*f* of the developer delivery passage 11 shown in FIG. 6. Therefore, when the front cover U2 is opened and the replacement frame Ut is removed to thereby remove the developing devices Gy, Gm, Gc and Gk, the flow-out opening shutter 12 is moved to the closing position by the spring 13 to thereby be able to prevent the leakage of the developer. On the other hand, when the replacement frame Ut is mounted to thereby mount the developing devices Gy, Gm, Gc and Gk, the flow-out opening shutter 12 is pushed and moved by the portions to be connected 16 (see FIG. 6) of the developing devices Gy, Gm, Gc and Gk, whereby the developing device connecting portions 9*a* are fitted with the portions to be connected 16, which makes it possible to supply the developer from the flow-out openings 11 to the developing devices Gy, Gm, Gc and Gk.

Figure 11:
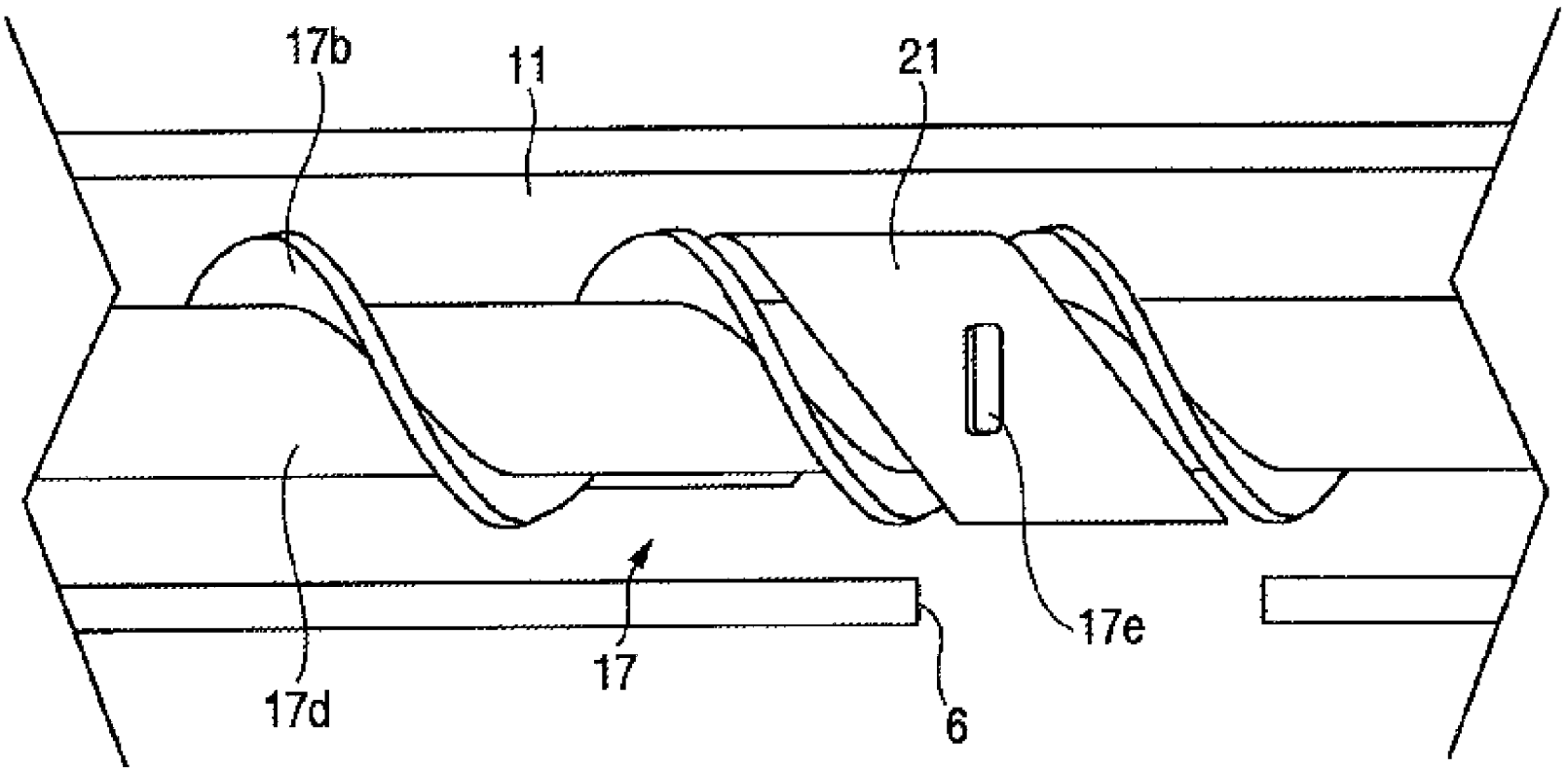
FIG. 11 is an explanatory enlarged view of the main portions of the flow-in opening portion of the developer delivery device according to the exemplary embodiment 1 of the invention.

FIG. 11 is an enlarged explanatory view of the main portions of the flow-in opening portion of the developer delivery device according to the embodiment 1 of the invention.

Figure 12:
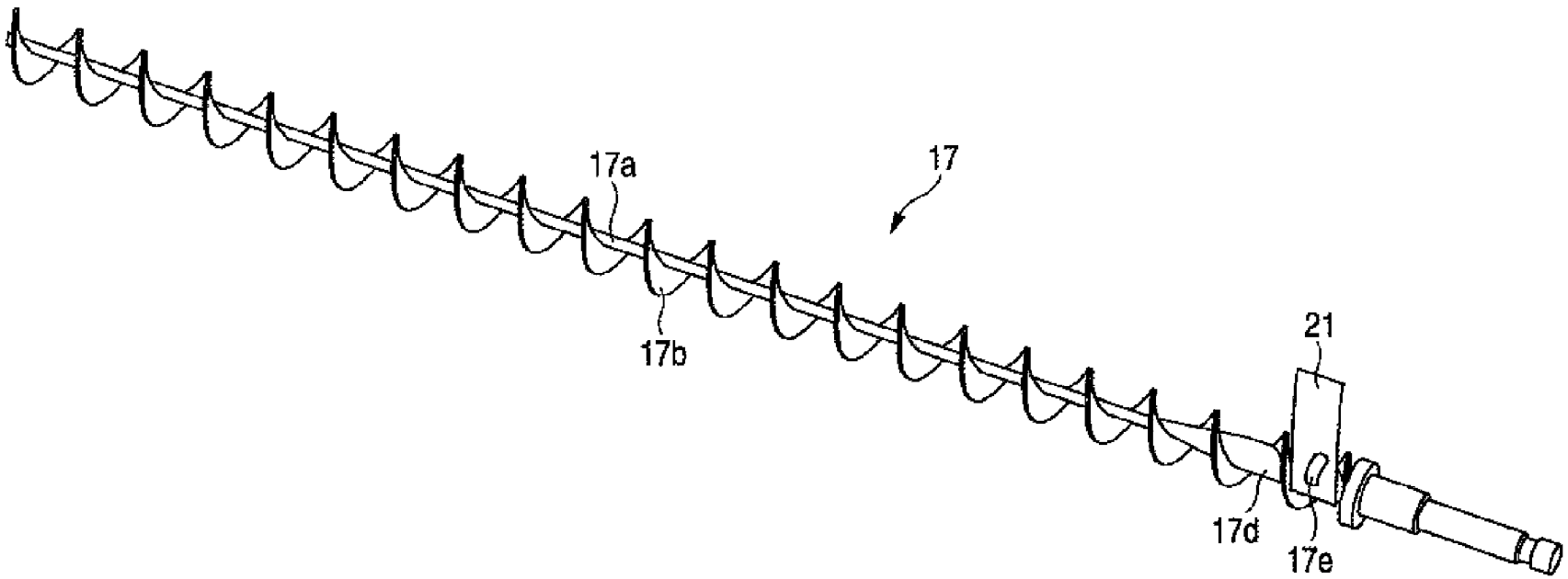
FIG. 12 is an explanatory view of a developer delivery member according to the exemplary embodiment 1 of the invention.

FIG. 12 is an explanatory view of the developer delivery member according to the embodiment 1 of the invention.

In FIGS. 6B, 11 and 12, within the developer delivery passage 11, there is rotatably supported a developer delivery member 17 along the curved developer delivery passage 11. In FIGS. 10 to 12, the developer delivery member 17 includes a rotation shaft 17*a* and a spiral-shaped delivery blade 17*b* formed in the outer periphery of the rotation shaft 17*a*. According to the embodiment 1, the developer delivery member 17 is made of flexible resin material and, when rotated, it delivers toner as an example of a developer while it is curved along the shape of the developer delivery passage 11. In FIG. 11, in the position of the developer delivery member 17 that corresponds to the flow-in opening 6, there is formed a large diameter portion 17*d* which is larger in diameter than the rotation shaft 17*a*, while the large diameter portion 17*d* includes a clogging preventive member mounting portion 17*e*.

In FIGS. 5B and 6B, on the rear end portion of the frame body 2, as an example of a supplying drive system, there is supported a supplying motor 19 for each color. In FIG. 10, on a drive shaft 19*a* which extends from the supplying motor 19, there is supported a drive gear 20 as an example of a drive force transmission member; and, when the drive gear 20 transmits a drive force to a gear 17*g* which is supported on the rear end of the developer delivery member 17 and functions as an example of a drive receiving transmission member, the developer delivery member 17 is driven to thereby deliver the toner. In FIGS. 6 to 8, the drive gear 20 is meshingly engaged with a cartridge drive gear 20*a* which, as an example of a developer storage container drive transmission member, is disposed in the front side portion of the opening 2*h*. The cartridge drive gear 20*a* is disposed in such a manner that a portion of the outer periphery thereof is exposed to the outside.

In FIGS. 11 and 12, on the clogging preventive member mounting portion 17*e* of the developer delivery member 17, there is fixed and supported one end portion of a clogging preventive member 21. According to the embodiment 1, the clogging preventive member 21 is formed in a flexible thin film shape, that is, in a so called film shape and can be made of resin such as PET (polyethylene terephtalate) or PPS (polyphenylene sulfide). The clogging preventive member 21 is structured such that it can rotate in contact with the inner peripheral surface of the developer delivery passage 11 while it is elastically deformed and flexed. And, in a state where the leading end of the clogging preventive member 21 is moved to a position corresponding to the flow-in opening 6, the clogging preventive member 21 is allowed to extend due to its own restoring force and move into the flow-in opening 6 from the developer delivery passage 11, thereby being able to prevent the clogging of the flow-in opening 6. Also, the clogging preventive member 21 is structured such that, within the developer delivery passage 11, it can be elastically deformed in such a manner to wind around the rotation shaft 17*a* and can be stored into between the delivery blades 17*b*, whereby it is difficult to break.

The respective members, to which the reference numerals 2 to 21 are given, cooperate together in constituting the developer delivery device 1 according to the embodiment 1.

(Description of Developer Supply Case)

FIG. 13 is a perspective view of a developer storage case according to the embodiment 1 of the invention. Specifically, FIG. 13A is a perspective view of the developer storage case, when it is viewed from front right obliquely above; FIG. 13B is a perspective view of the developer storage case, when it is viewed from front left obliquely below; FIG. 13C is a perspective view of the developer storage case, when it is viewed from rear left obliquely above; and, FIG. 13D is a perspective view of the developer storage case, when it is viewed from rear right obliquely above.

FIG. 14 is an explanatory view of the developer storage case according to the embodiment 1 of the invention. Specifically, FIG. 14A is a plan view of the developer storage case; FIG. 14B is a view of the developer storage case, when it is viewed from the direction of the arrow mark XIVB shown in FIG. 14A; FIG. 14C is a section view taken along the XIVC-XIVC line shown in FIG. 14A; FIG. 14D is a section view taken along the XIVD-XIVD line shown in FIG. 14A; FIG. 14E is a section view taken along the XIVE-XIVE line shown in FIG. 14A; and, FIG. 14F is a section view taken along the XIVF-XIVF line shown in FIG. 14B.

Figure 15:
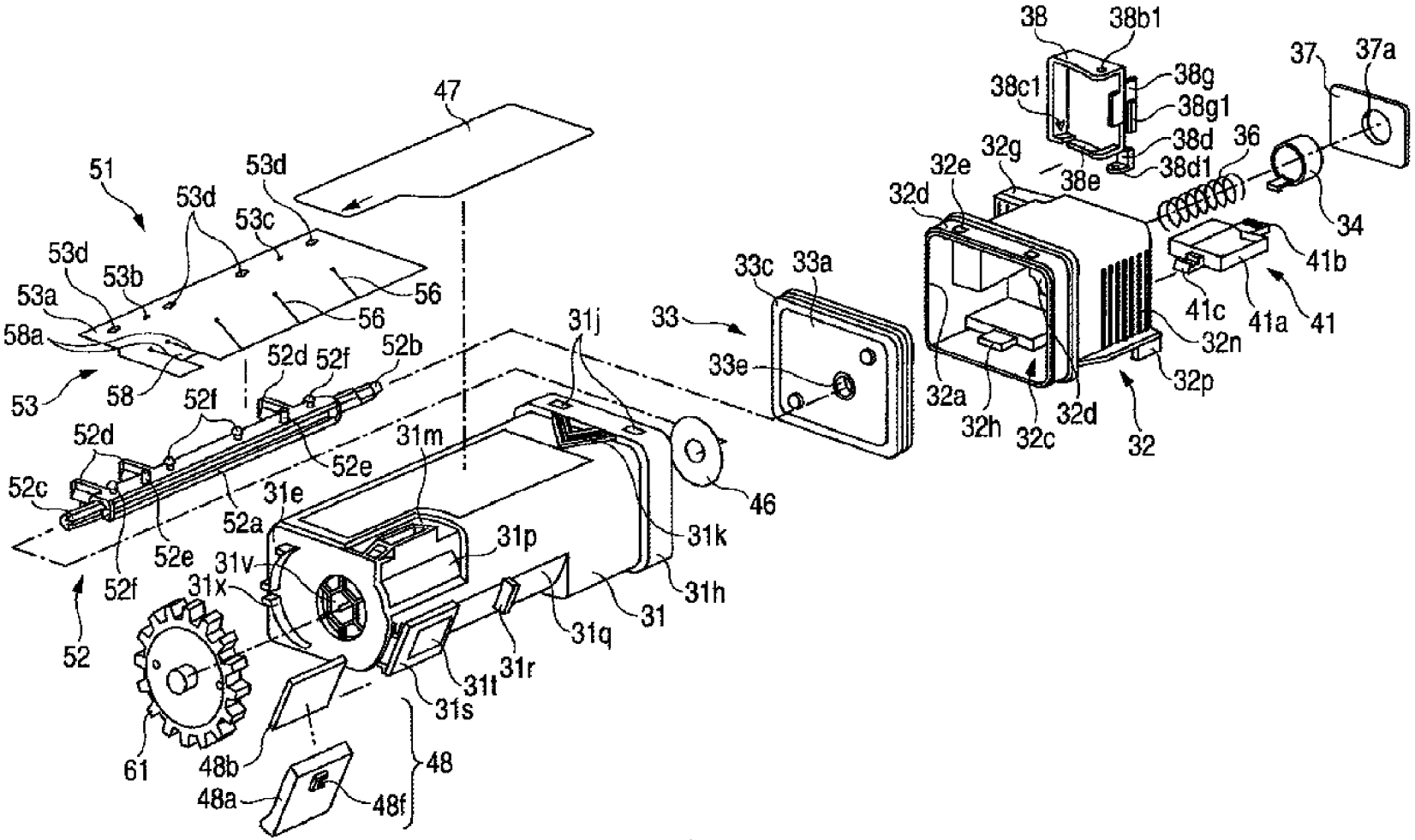
FIG. 15 is an exploded view of a developer supply case according to the exemplary embodiment 1.

FIG. 15 is an exploded view of the developer supply case according to the embodiment 1 of the invention.

In FIGS. 3, 4, 13, 14 and 15, each of the toner cartridges TCy, TCm, TCc and TCk as an example of the developer storage case according to the embodiment 1 is formed in a flat and substantially cuboid shape the horizontal direction width of which is larger than the vertical direction height thereof. Each of the toner cartridges TCy, TCm, TCc and TCk includes a box-shaped supply developer storage case 31 having an opening formed in one end portion thereof for supplying a developer, and a box-shaped waste developer storage case 32 having an opening formed opposed to the opening of the supply developer storage case 31. In FIG. 14, the supply developer storage case 31 and waste developer storage case 32 are divided by a partition member 33. That is, in order to solve a technological problem that the supply developer storage case 31 and waste developer storage case 32 are not provided separately but they can be replaced as an integral body, the supply developer storage case 31 and waste developer storage case 32 are connected together. Also, in order to solve a technological problem to reduce the size of the toner cartridges TCy, TCm, TCc and TCk, the supply developer storage case 31 and waste developer storage case 32 are not closed respectively but are separated by the single partition member 33, whereby the size of each toner cartridge can be reduced, the number of parts thereof can be decreased and the cost thereof can be reduced. Further, in order to solve a technological problem to be able to secure the maximum developer storage amount in a limited space within the image forming apparatus U, the whole of the toner cartridge is formed in a cuboid shape.

(Description of Supply Developer Storage Case)

Figures 16A, 16B, 16C, 16D, 16E, 16F:
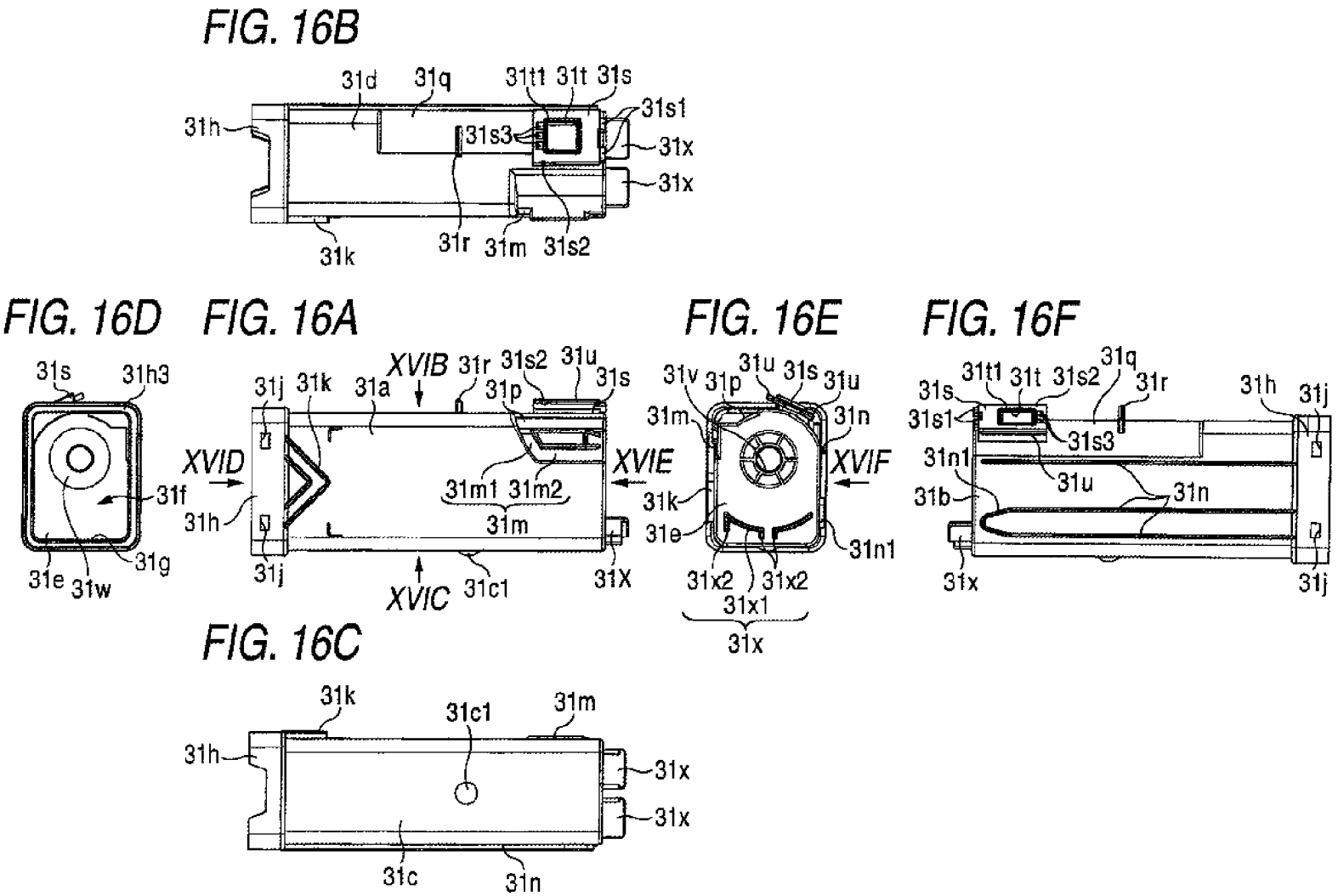
FIGS. 16A to 16F are six views of a supply developer storage case as an example of a storage case according to the exemplary embodiment 1, specifically.

FIG. 16 is six views of the supply developer storage case as an example of a storage case according to the embodiment 1. Specifically, FIG. 16A is a plan view of the supply developer storage case, FIG. 16B is a view of the supply developer storage case when it is viewed from the direction of the arrow mark XVIB shown in FIG. 16A, FIG. 16C is a view of the supply developer storage case when it is viewed from the direction of the arrow mark XVIC shown in FIG. 16A, FIG. 16D is a view of the supply developer storage case when it is viewed from the direction of the arrow mark XVID shown in FIG. 16A, FIG. 16E is a view of the supply developer storage case when it is viewed from the direction of the arrow mark XVIE shown in FIG. 16A, and FIG. 16F is a view of the supply developer storage case when it is viewed from the direction of the arrow mark XVIF shown in FIG. 16E.

In FIGS. 13 to 16, the supply developer storage case 31, which is disposed on the rear side of each of the toner cartridges TCy, TCm, TCc and TCk, includes a top wall 31*a*, a bottom wall 31*b*, a right side wall 31*c*, a left side wall 31*d* and a rear end wall 31*e* as an example of one end wall. A space, which is surrounded by the respective walls 31*a* to 31*e*, constitutes a supply developer storage space 31*f*; and, in the front end portion of the supply developer storage case 31 where no wall is formed, there is formed an opening 31*g*. The supply developer storage case 31 includes a connecting portion 31*h* formed in the front end portion thereof. In the right and left portions of the connecting portion 31*h*, there are formed notch-shaped connecting recessed portions 31*h*1 and 31*h*2, while the right side connecting recessed portion 31*h*1 and left connecting recessed portion 31*h*2 are formed different in shape from each other in order to prevent the wrong mounting of the waste developer storage case 32. Also, in the inner surface of the connecting portion 31*h*, as an example of an opening closing member support portion, there is formed a step-shaped partition member support portion 31*h*3.

In the upper and lower surfaces of the connecting portion 31*h*, there are formed four connecting holes 31*j*.

The rear top wall 31*a* of the connecting portion 31*h* includes, on the outer surface thereof, a dual mounting time positioned portion 31*k* which is formed in an isosceles triangle shape having a vertex in the rear portion thereof and is projected upwardly. The mounting time positioned portion 31*k* is fitted into the positioning cut-away portion 4*c* and is thereby positioned in a state where the toner cartridges TCy, TCm, TCc and TCk are respectively stored in their associated cartridge storage cases 4. That is, in order to solve a technological problem to facilitate the visual recognition of the insertion direction and positioning of the toner cartridge, there is employed the isosceles triangle shaped mounting time positioned portion 31*k* having a vertex set in the rear portion thereof which is the insertion direction thereof.

In the left portion of the rear end portion of the top wall 31*a*, as an example of a mounting position regulate portion, there is formed a mounting position rotation regulated portion 31*m* into which the rotation regulate portion 2*g* can be fitted in the mounting time of the toner cartridge TCy, TCm, TCc and TCk. The mounting position rotation regulated portion 31*m* includes a slanting portion 31*m*1 extending right obliquely backward from the left end of the portion 31*m* and a rearward extending portion 31*m*2 extending rearward from the right end of the slanting portion 31*m*1.

In FIG. 16F, on the lower surface of the bottom wall 31*b*, there are provided, as an example of a portion be guided, three ribs to be guided 31*n* which extend parallel to each other in the back and forth direction. In the rear end portion of the rib to be guided 31*n*, there is formed a slanting guide portion 31*n*1. When the toner cartridges TCy, TCm, TCc and TCk are stored into their associated cartridge storage cases 4, they are guided by the guide ribs 4*b* and are mounted in a state where their relative positions to their associated cartridge storage cases 4 are guided to given positions. That is, the ribs to be guided 31*n* and guide ribs 4*b* are provided in order to solve a technological problem to enhance the linear accuracy of the insertion of the toner cartridges TCy, TCm, TCc and TCk into their associated cartridge storage cases 4.

In FIGS. 16A and 16C, on the right side wall 31*c*, there is provided a mounting sense operation engaging portion 31*c*1 which is composed of a semi-spherical-shaped projection projecting outwardly. The mounting sense operation engaging portion 31*c*1 is structured such that, in the middle of the operation to store the toner cartridges TCy, TCm, TCc and TCk into their associated cartridge storage cases 4, it is contacted with the mounting sense operation portion 4*d* and is thereby elastically deformed and, when it is pushed in further by the mounting sense operation portion 4*d*, it can be restored due to its elastic force. Therefore, the mounting sense operation engaging portion 31*c*1 and mounting sense operation portion 4*d* are provided in order to solve a technological problem to apply a mounting sense, namely, a so called click sense to an operator, who mounts the toner cartridges TCy, TCm, TCc and TCk, to thereby allow the operator to recognize the mounting of the toner cartridges through senses, that is, to make it easier for a user to recognize that the toner cartridges TCy, TCm, TCc and TCk have been mounted.

In FIG. 16A, on the upper side of the rear end portion of the left side wall 31*d*, there is disposed a member pass portion 31*p* which is formed in correspondence to the back and forth direction width of the mounting position rotation regulated portion 31*m* and has an arc-shaped outer shape. The member pass portion 31*p* is provided so as to solve a technological problem that, when mounting the toner cartridge, the cartridge drive gear 20*a* can be prevented from colliding or interfering with the wall surface of the supply developer storage case 31; and, the member pass portion 31*p* is formed in a shape which is recessed with respect to the other outer shape portions of the left side wall 31*d*.

On the lower side of the rear end portion of the left side wall 31*d*, as an example of an opening/closing member pass portion, there is provided a shutter pass portion 31*q* having an arc-shaped outer shape so as not to interfere with the flow-in opening forming portion 5. The outer shape of the shutter pass portion 31*q* is formed to be recessed with respect the front side portion of the left end wall 31*d*. On the back and forth direction central portion of the shutter pass portion 31*q*, as an example of an opening/closing member move portion, there is provided a shutter moving projection 31*r* which projects outwardly. Also, when the shutter lock portion 5*b* is pushed inwardly and is thus elastically deformed to thereby remove the locking of the main body side shutter 7 in the toner cartridge mounting operation, the shutter moving projection 31*r* also functions as a regulation remove member. And, the shutter moving projection 31*r* is contacted with the front end face of the main body side shutter 7, whereby, when the toner cartridges TCy, TCm, TCc and TCk move backward from front, the shutter moving projection 31*r* presses against the main body side shutter 7 to thereby move it from its open position to its closed position.

In FIG. 16B, the rear end portion of the shutter pass portion 31*q*, there is formed a discharge opening forming portion 31*s* which projects to the right. In the discharge opening forming portion 31*s*, there is formed a supply developer discharge opening 31*t* as an example of a discharge opening which communicates with a supply developer storage space 31*f* and is connected to the flow-in opening 6 of the developer delivery device 1.

In FIG. 16, the discharge opening forming portion 31*s* includes, as an example of an opening/closing guide portion, a cartridge shutter guide portion 31*u* which extends in the back and forth direction of the discharge opening forming portion 31*s*.

In FIG. 16B, the discharge opening forming portion 31*s* includes, as an example of an opening/closing member smooth mounting portion, shutter mounting guide portions 31*s*1 which are formed in the rear end portion of the discharge opening forming portion 31*s* and have a slope shape that becomes smaller in thickness as it goes backward. Also, in the upper front portion of the discharge opening forming portion 31*s*, there is formed a notch-shaped shutter removal preventive recessed portion 31*s*2 as an example of an opening/closing member removal preventive portion. In the discharge opening forming portion 31*s*, as an example of a developer storage portion, there are formed three storage recessed portions 31*s*3 which are adjacent to the front side of the supply developer discharge opening 31*t*. The storage recessed portions 31*s*3, when mounting or removing the toner cartridges TCy, TCm, TCc and TCk, are interposed between the flow-in opening 6 and supply developer discharge opening 31*t*, and are used to provisionally store therein the developer that is going to leak when the flow-in opening is opened or closed due to the movement of the main body side shutter 7 or when the supply developer discharge opening 31*t* is opened or closed, thereby preventing the developer from leaking into the image forming apparatus U or from contaminating the interior of the image forming apparatus U.

Also, in FIG. 16B, in the periphery of the supply developer discharge opening 31*t*, there is formed, as an example of a leakage preventive portion, an edge-shaped sealing rib 31*t*1 which projects outwardly. That is, the sealing rib 31*t*1 is provided in order to solve a technological problem to enhance the sealing performance of the supply developer discharge opening 31*t* with respect to a cartridge shutter (48) which will be discussed later.

In FIGS. 15 and 16E, in the outer surface of the rear end wall 31*e*, there is formed a shaft support hole 31*v* which is situated at a position shifted to the left side and penetrates through the rear end wall 31*e*.

In FIGS. 14 and 16D, in the inner surface of the rear end wall 31*e* of the supply developer storage case 31, there is formed a seal member bonding portion 31*w* which is composed of a ring-shaped base portion.

In FIGS. 14 to 16, on the left portion of the rear end wall 31*e*, there are provided, as an example of a case kind judge portion, kind judge projections 31*x* which project backwardly. The kind judge projection 31*x* includes an arc portion 31*x*1 formed so as to correspond to a gear (61) (which will be discussed later) and a judge portion 31*x*2 which extends to the left from a given position in the arc portion 31*x*1. The forming position and number of the judge portion 31*x*2 differ according to the respective colors, Y, M, C and K; and, it is structured such that it corresponds to a recessed portion (not shown) formed in the rear end wall of the cartridge storage case. Only when the colors coincide with each other, the projection 31*x* and recessed portion can be fitted with each other, so that the toner cartridges TCy, TCm, TCc and TCk can be mounted onto their associated cartridge storage cases 4*y*, 4*m*, 4*c* and 4*k*. But, when the colors are different from each other, the projection 31*x* is not fitted into the recessed portion but is caught on the rear end wall, so that the toner cartridges TCy, TCm, TCc and TCk cannot be mounted onto their associated cartridge storage cases 4*y*, 4*m*, 4*c* and 4*k*, thereby being able to prevent a possibility that the toner cartridges TCy, TCm, TCc and TCk can be stored into the cartridges 4 of different colors in error. That is, the kind judge projection 31*x* is provided in order to solve a technological problem to prevent the wrong mounting of the toner cartridges TCy, TCm, TCc and TCk. By the way, the kind judge projections 31*x* for respective colors can be molded easily using bushings when the supply developer storage case 31 is integrally molded using a die assembly.

(Description of Waste Developer Storage Case)

FIG. 17 is a perspective view of a waste developer storage case according to the embodiment 1 of the invention. Specifically, FIG. 17A is a perspective view when it is viewed from right front obliquely above, FIG. 17B is a perspective view when it is viewed from left front obliquely below, FIG. 17C is a perspective view when it is viewed from left rear obliquely below, and FIG. 17D is a perspective view when it is viewed from right rear obliquely above.

FIG. 18 is six views of the waste developer storage case according to the embodiment 1 of the invention. Specifically, FIG. 18A is a plan view, FIG. 18B is a view when it is viewed from the direction of the arrow mark XVIIIB shown in FIG. 18A, FIG. 18C is a view when it is viewed from the direction of the arrow mark XVIIIC shown in FIG. 18A, FIG. 18D is a view when it is viewed from the direction of the arrow mark XVIIID shown in FIG. 18A, FIG. 18E is a view when it is viewed from the direction of the arrow mark XVIIIE shown in FIG. 18A, and FIG. 18F is a view when it is viewed from the direction of the arrow mark XVIIIF shown in FIG. 18E.

In FIGS. 13 to 15, 17 and 18, the waste developer storage case 32, which is disposed on the front side of the toner cartridges TCy, TCm, TCc and TCk, includes a waste side case main body 32*b* which is formed in a cuboid shape having a rearward opened opening 32*a*. In the interior of the waste side case main body 32*b*, there is formed a waste developer storage space 32*c* into which, in the image forming operation, there are stored sensitive member cleaners CLy, CLm, CLc and CLk and waste developers collected by a belt cleaner CLb.

In FIGS. 17 and 18, in the rear end portion of the waste side case main body 32*b*, there is formed a portion to be connected 32*d* which can be fitted with and connected to the inside of the connecting portion 31*h* of the supply developer storage case 31.

On the portion to be connected 32*d*, there is provided a pawl portion 32*e* which can be fitted with and connected to the connecting hole 31*j* of the connecting portion 31*h*. That is, the connecting hole 31*j* and pawl portion 32*e* are provided in order to solve a technological problem that, in a state where the waste developer storage case 32 and supply developer storage case 31 are mounted, they are difficult to remove but can be decomposed.

Also, the portion to be connected 32*d* includes a right side connecting projecting portion 32*f*1 and a left side connecting projecting portion 32*f*2 which are respectively formed so as to correspond to a right side connecting recessed portion 31*h*1 and a left side connecting recessed portion 31*h*2. Therefore, in order to prevent the wrong mounting of the waste developer storage case 32, in correspondence to the fact that the right side connecting recessed portion 31*h*1 and left side connecting recessed portion 31*h*2 are different in shape from each other, the right side connecting projecting portion 32*f*1 and left side connecting projecting portion 32*f*2 are different in shape from each other. That is, in order to solve a technological problem to prevent the wrong assembling of the supply developer storage case 31 and waste developer storage case 32, there are provided the right side connecting recessed portion 31*h*1 and left side connecting recessed portion 31*h*2 different in shape from each other as well as the right side connecting projecting portion 32*f*1 and left side connecting projecting portion 32*f*2 which are different in shape from each other in correspondence to the former two portions.

By the way, the height of the right side connecting projecting portion 32*f*1 and left side connecting projecting portion 32*f*2 is set such that they are almost flush with the outer surface of the connecting portion 31*h* of the supply developer storage case 31. Therefore, in a state where the connecting portion 32*f* is connected to the connecting portion 31*h*, a fixing tape Tp (see FIG. 13) can be bonded over both the connecting portion 31*h* of the supply developer storage case 31 and the connecting projecting portions 32*f*1, 32*f*2 of the waste developer storage case 32. That is, the connecting projecting portions 32*f*1 and 32*f*2 are provided in order to solve a technological problem to prevent a possibility that the fixing tape Tp can be bonded only to the outer periphery of the supply developer storage case 31 and thus the fixation by the tape Tp can be insufficient.

In FIGS. 15, 17 and 18, in the front side right portion of the waste side case main body 32*b*, as an example of an operation member fixing portion, there is integrally formed a handle fix portion 32*g* which includes a projection-shaped rotation center portion 32*g*1. In FIGS. 17D and 18, in the rear surface of the handle fix portion 32*g*, there is formed a slippage preventive uneven portion 32*g*2. In FIG. 17A, in the right lower portion of the handle fix portion 32*g*, there is formed a plate spring support portion 32*g*3. Also, at the back of the slippage preventive uneven portion 32*g*2, there is formed an operation space 32*g*4 into which the user can put his or her finger to operate it when a user pushes the back surface of the handle fix portion 32*g*.

Figure 17A:
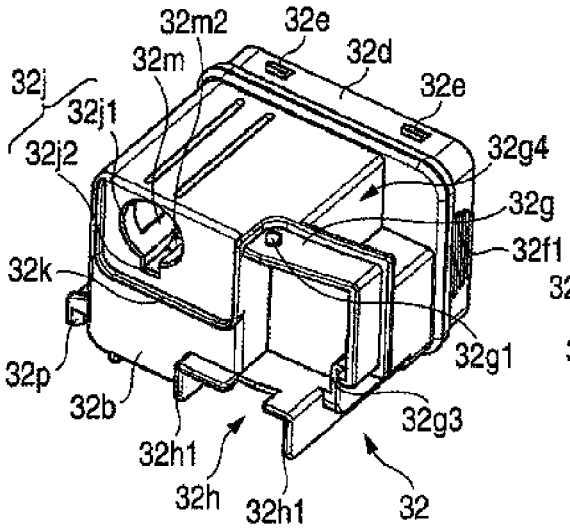
FIGS. 17A to 17D are perspective views of a waste developer storage case according to the exemplary embodiment 1, specifically.
Figure 17B:
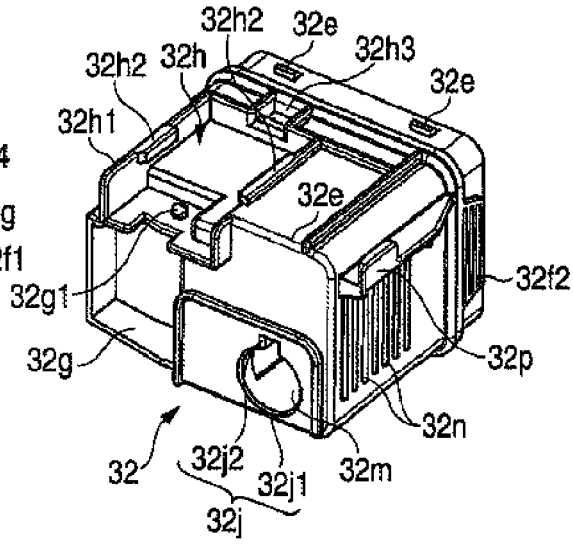
Figure 17C:
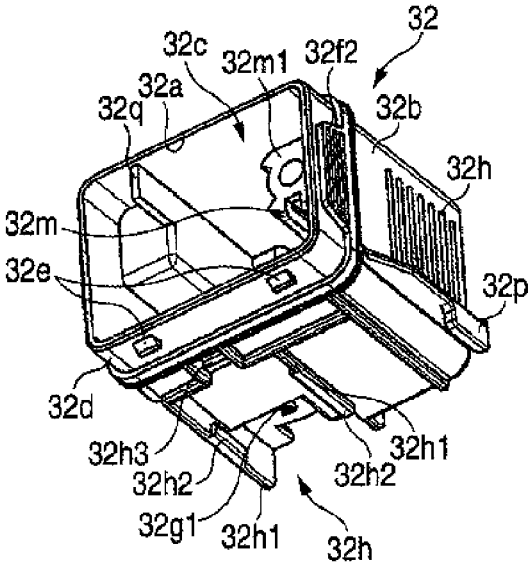

Downwardly of the handle fix portion 32*g*, there is formed a CRUM mounting portion 32*h* as an example of a memory member mounting portion. On the CRUM mounting portion 32*h*, there is provided a protect rib 32*h*1 and, in the protect rib 32*h*1, there is formed a memory member mounting guide 32*h*2 as an example of a memory member mounting guide portion. In FIGS. 17B, 17C and 18, in the rear end portion of the CRUM mounting portion 32*h*, there is formed a paw engaging portion 32*h*3 as an example of a memory member fixing portion.

On the left of the handle fix portion 32*g*, there is formed a waste developer flow-in opening 32*j*. The waste developer flow-in opening 32*j* includes a round hole portion 32*j*1 and a removal preventive mounting time pass portion 32*j*2 extending downwardly from the round hole portion 32*j*1.

In the periphery of the waste developer flow-in opening 32*j*, there is provided, as an example of a leakage preventive member protect portion, a leakage preventive member protect rib 32*k* in such a manner that it surrounds the waste developer flow-in opening 32*j*.

In the inside of the waste developer storage space 32*c* at the rear of the waste developer flow-in opening 32*j*, there is formed a cylindrical-shaped energizing member support portion 32*m*. The energizing member support portion 32*m* includes a rear end wall 32*m*1 functioning as an energizing member one end support portion. Also, the energizing member support portion 32*m* further includes a step-shaped removal preventive portion 32*m*2 formed in the front portion thereof.

In FIGS. 17B, 17C and 18, in the left outer surface of the waste side case main body 32*b*, there is formed an uneven portion 32*n* for prevention of slippage. That is, in order to solve a technological problem to prevent a possibility that, when removing the toner cartridges TCy, TCm, TCc and TCk, they can slip off and fall down and can be thereby broken or contaminated with the developer, the slippage preventive uneven portion 32*n* is provided on the left outer surfaced of the waste side case main body 32*b* that may be held by a user with high possibility.

Downwardly of the slippage preventive uneven portion 32*n*, as an example of a front side portion to be guided, there is formed a front side portion to be guided 32*p* which can be fitted with and guided by the front side guide portion 2*m* shown in FIG. 6. That is, in order to solve a technological problem to enhance the accuracy of the linear movement of the toner cartridges TCy, TCm, TCc and TCk when moving these toner cartridges forward from behind for mounting, there are formed the front side guide portion 2*m* and front side guided portion 32*p*.

Figure 17D:
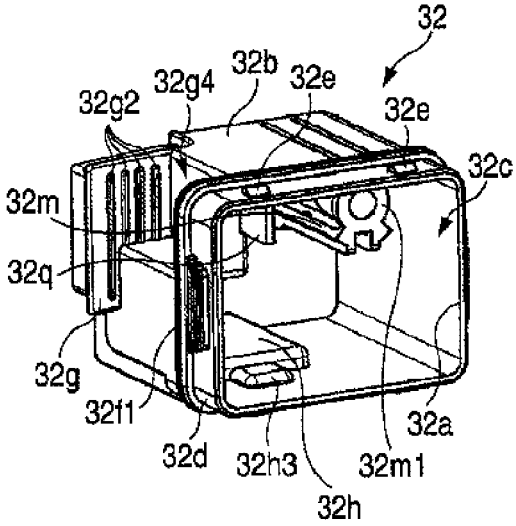
Figure 18B:
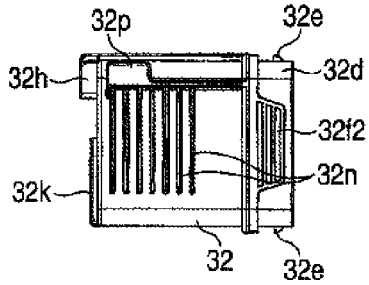
FIGS. 18A to 18F are six views of a waste developer storage case as an example of a storage case according to the exemplary embodiment 1, specifically.
Figure 18D:
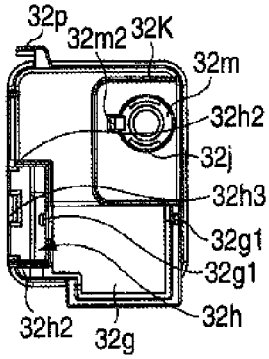
Figure 18A:
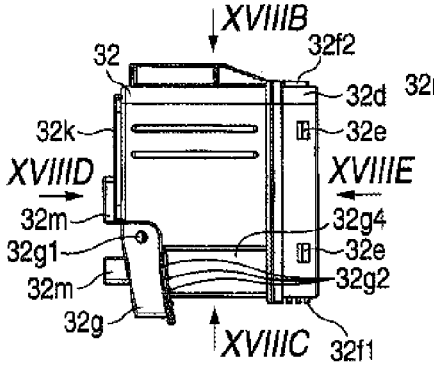
Figure 18E:
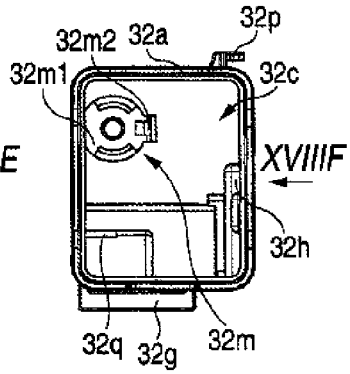
Figure 18C:
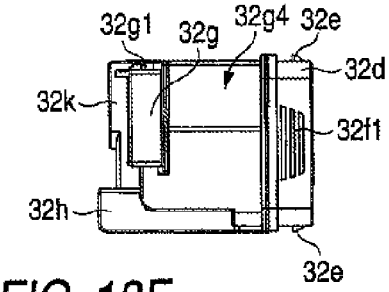
Figure 18F:
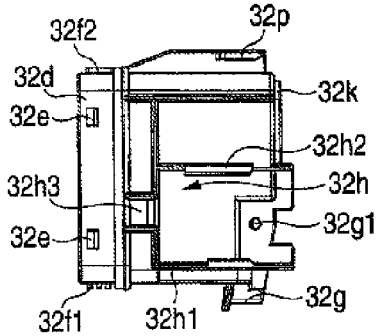

In FIGS. 17C and 17D, left upwardly of the inside of the waste developer storage case 32*c*, there is formed a wrong mounting time interference portion 32*q* which extends backwardly but does not project outwardly beyond the portion to be connected 32*d*.

(Description of Partition Member)

Figure 19A:
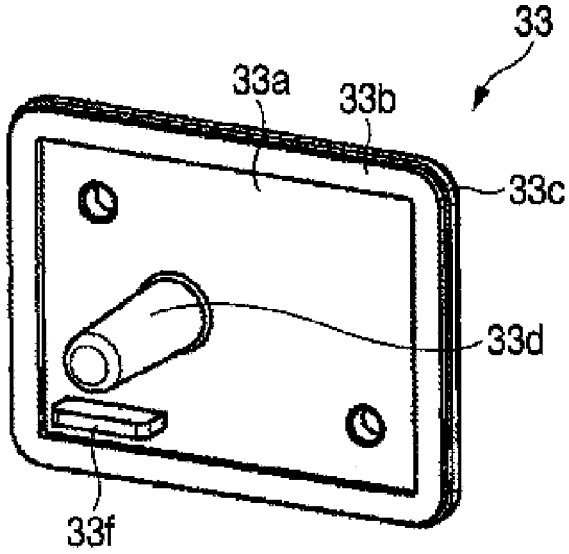
FIGS. 19A and 19B are perspective views of a partition member according to the exemplary embodiment 1, specifically.
Figure 19B:
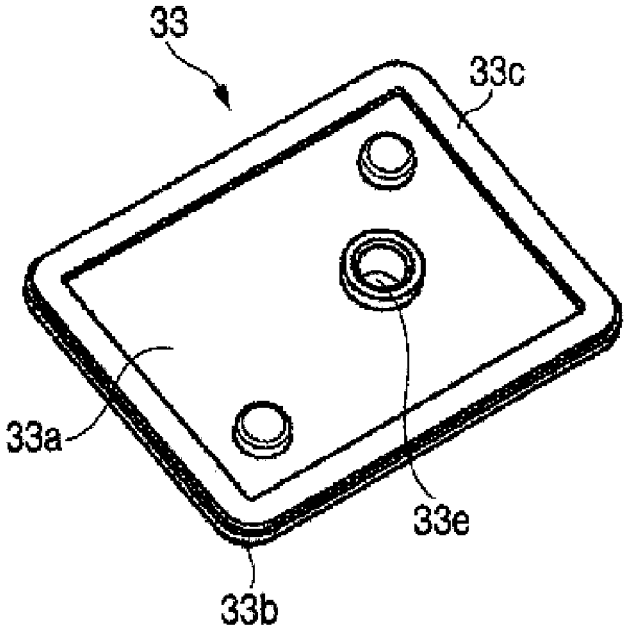

FIG. 19 is a perspective view of a partition member according to the embodiment 1. Specifically, FIG. 19A is a perspective view when it is viewed from right front obliquely above, and FIG. 19B is a perspective view when it is viewed from right rear obliquely below.

In FIGS. 14, 15 and 19, the partition member 33, which is used as an example of the other end side support member or opening closing member, includes an angular-plate-shaped partition member main body 33*a*. On the front and rear surfaces of the partition member main body 33*a*, there are provided seal portions 33*b* and 33*c* in such a manner that they edge the outer periphery edge of the partition member main body 33*a*. In the partition member main body 33*a*, as an example of the other side rotation support portion, there is formed a front side shaft support portion 33*d* at a position biased from the center of the main body 33*a* to the left thereof. The front side shaft support portion 33*d* is formed in a hollow conical shape which projects forwardly and, as shown in FIG. 14C, in the inside thereof, there is formed a shaft insertion hole 33*e*. In the left lower portion of the partition member main body 33*a*, there is formed a wrong mounting time interfered portion 33*f* which projects forwardly.

According to the embodiment 1, the partition member main body 33*a* is made of resin and the seal portions 33*b*, 33*c* are made of rubber, while the partition member main body 33*a* and the seal portions 33*b*, 33*c* are formed as an integral body by two color molding. That is, in order to solve a problem to enhance the productivity of the partition member 33, the partition member main body 33*a* and seal portions 33*b*, 33*c* are formed as an integral body. Also, in order to solve a technological problem to reduce the cost of the partition member, the seal portions 33*b* and 33*c* are formed only in the outer peripheral edge portion that must be sealed, whereas the seal portions 33*b* and 33*c* are not formed in the portions that need not be sealed.

In a state where the toner cartridges TCy, TCm, TCc and TCk have been assembled, the rear side seal portion 33*c* of the partition member 33 is pressed against the step-shaped partition member support portion 31*h*3 of the inner surface of the connecting portion 31*h* of the supply developer storage case 31*h*, whereby the partition member 33 is held in an elastically compressed state. And, when the waste developer storage case 32 is mounted onto the supply developer storage case 31, the front side seal portion 33*b* is pressed against the rear end of the portion to be connected 32*d* of the waste developer storage case 32, whereby the partition member 33 is held in an elastically compressed state. Therefore, the supply developer storage space 31*f* and waste developer storage space 32*c* are separated from each other in such a manner that they are sealed with respect to each other. That is, in order to solve a technological problem to enhance the sealing performance of the partition member 33, the thicknesses and hardness of the seal portions 33*b* and 33*c* are optimized. Also, in order to solve a technological problem to reduce the number of parts and thus reduce the cost of the partition member, the seal portions 33*b* and 33*c* are structured such that, in a state where the waste developer storage case 32 is mounted, they are compressed between the waste developer storage case 32 and supply developer storage case 31.

By the way, the waste developer storage case 32 and partition member 33 are structured such that, when the waste developer storage case 32 is going to be mounted onto the supply developer storage case 31 in a state where the partition member 33 is mounted in an inverted manner or upside down, the wrong mounting time interfering portion 32*q* and wrong mounting time interfered portion 33*f* interferes with each other, thereby being unable to assemble the partition member 33. That is, in order to solve a technological problem to prevent the wrong assembling of the partition member 33, the wrong mounting time interfering portion 32*q* and wrong mounting time interfered portion 33*f* are provided.

(Description of Waste Developer Shutter)

Figure 20A:
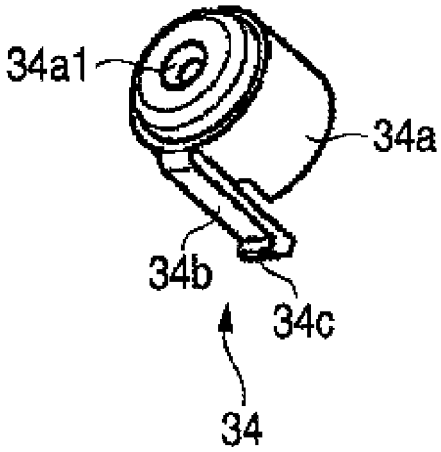
FIG. 20A to 20C are perspective views of a waste flow-in opening shutter according to the exemplary embodiment 1.
Figure 20B:
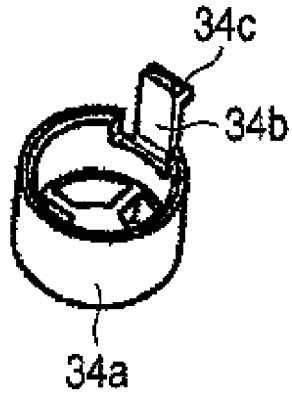
Figure 20C:
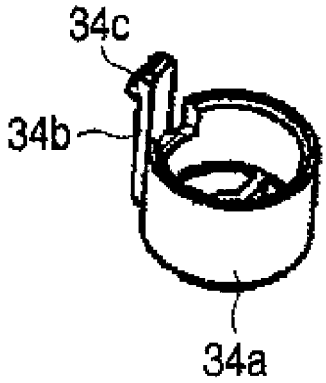

FIG. 20 is a perspective view of a waste flow-in shutter according to the embodiment 1. Specifically, FIG. 20A is a perspective view when it is viewed from right front obliquely below, FIG. 20B is a perspective view when it is viewed from right rear obliquely above, and FIG. 20C is a perspective view when it is viewed from left rear obliquely above.

In FIGS. 14, 15 and 20, on the waste developer flow-in opening 32*j* of the waste developer storage case 32, there is mounted a waste flow-in opening shutter 34 as an example of a waste developer flow-in opening/closing member. In FIG. 20, the waste flow-in opening shutter 34 includes a cylindrical shaped waste flow-in opening shutter main body 34*a* with the front side thereof closed. The waste flow-in opening shutter main body 34*a* includes, as an example of a removal preventive portion, a flexible plate spring portion 34*b* extending backwardly from the front end portion of the waste flow-in opening shutter main body 34*a*. In the rear end of the plate spring portion 34*b*, there is formed a removal preventive pawl portion 34*c*. Therefore, when the waste flow-in opening shutter 34 is inserted into the waste developer flow-in opening 32*j*, it is inserted in such a manner that the plate spring portion 34*b* is elastically deformed; and, when the removal preventive pawl portion 34*c* has passed through the removal preventive portion 32*m*2, the plate spring portion 34*b* is elastically restored, thereby being able to prevent the forward slippage of the waste flow-in opening shutter 34, that is, being able to prevent the waste flow-in opening shutter 34 against removal.

Figure 13C:
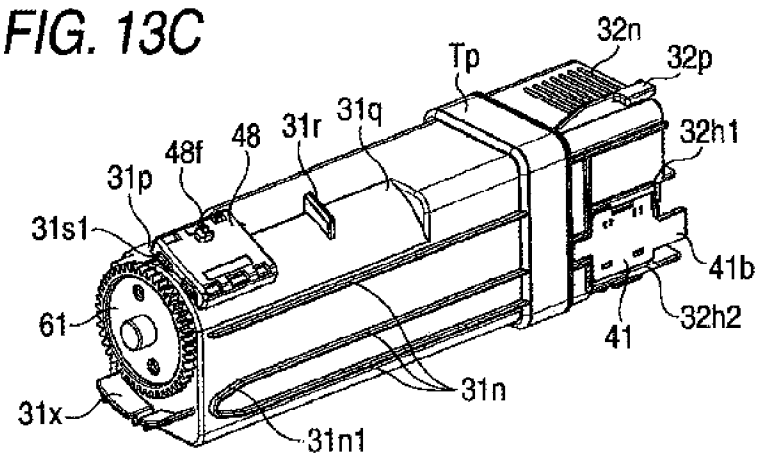
FIGS. 13A to 13D are an explanatory views of a developer storage case according to the exemplary embodiment 1 of the invention, specifically.
Figure 13D:
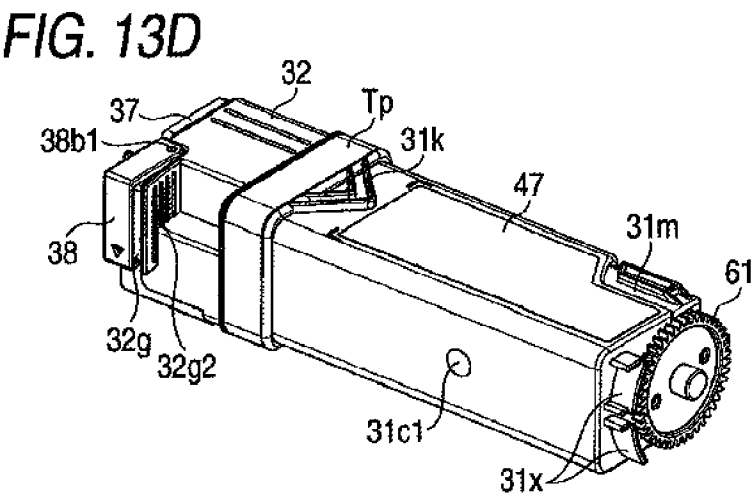
Figure 13A:
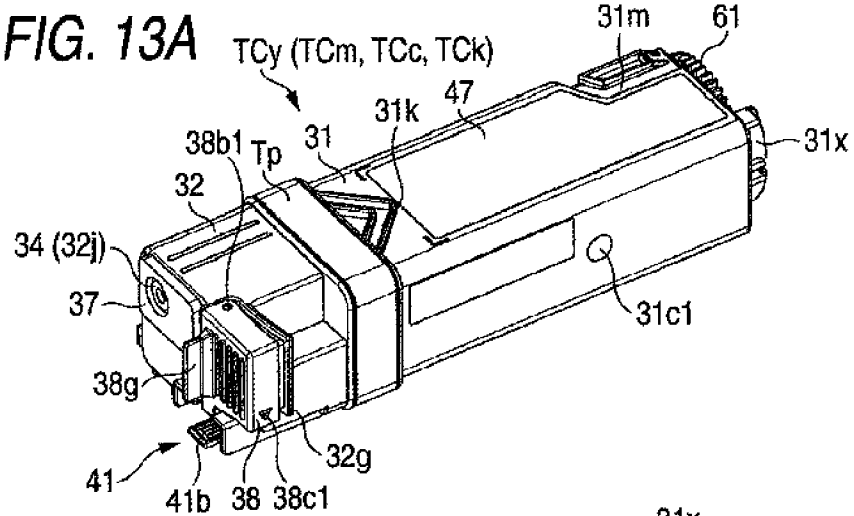
Figure 13B:
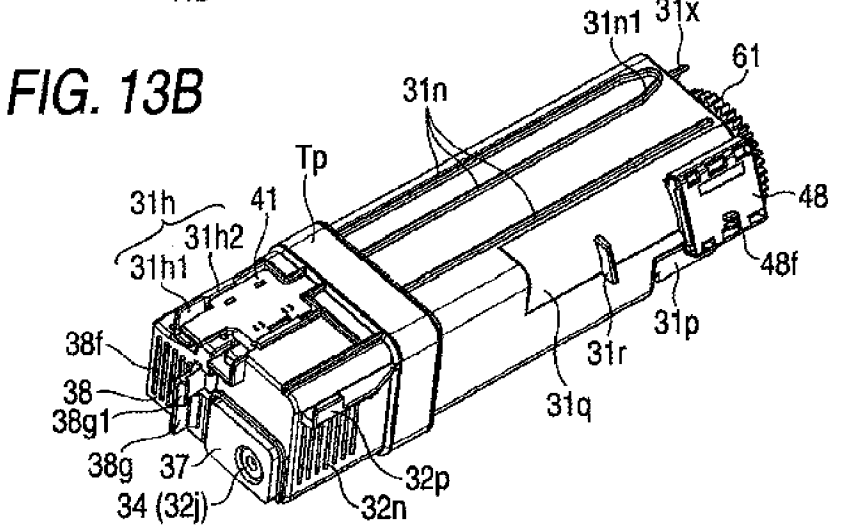
Figure 14D:
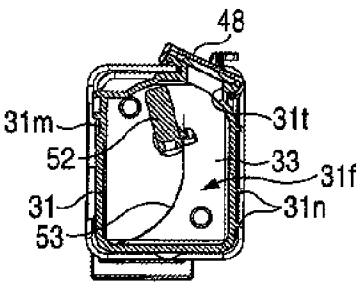
FIGS. 14A to 14F are explanatory views of the developer storage case according to the exemplary embodiment 1, specifically.
Figure 14B:
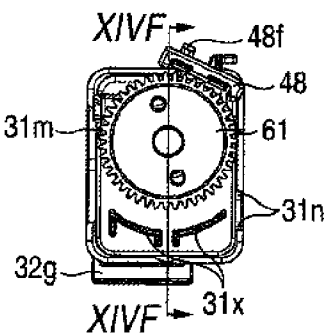
Figure 14E:
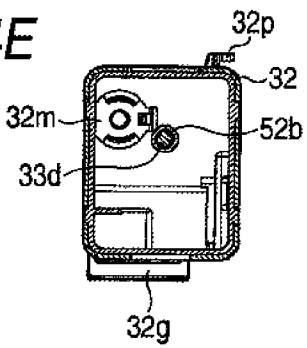
Figure 14A:
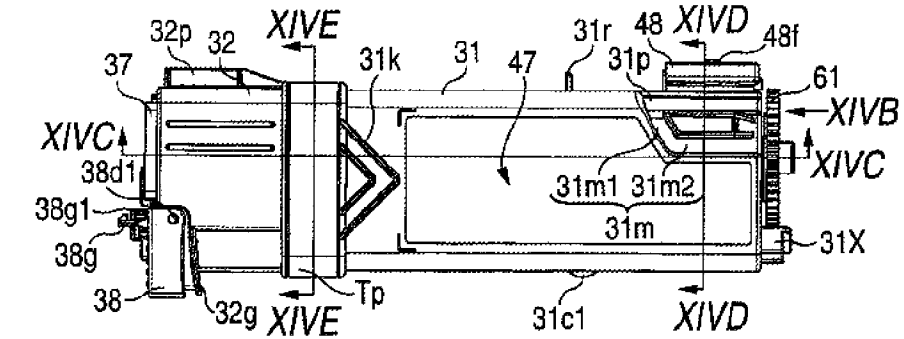
Figure 14C:
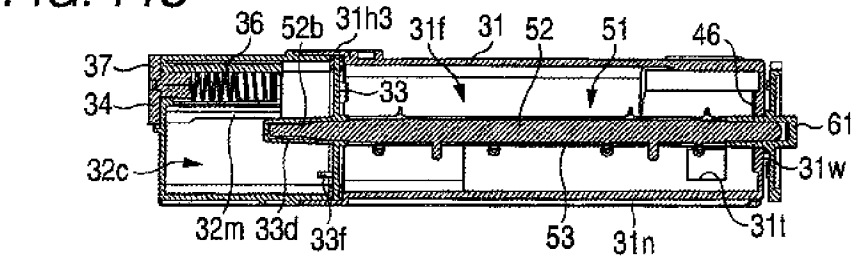

In FIGS. 14C and 15, on the energizing member support portion 32*m* of the waste developer storage case 32, there is supported a shutter spring 36 as an example of an energizing member for always energizing the rear end of the waste flow-in opening shutter 34 forwardly. Therefore, the waste flow-in opening shutter 34, normally, is held at a closing position for closing the waste developer flow-in opening 32*j* shown in FIGS. 4 and 13A not only by the energization of the shutter spring 36 but also by the removal preventive portion 32*m*2 and removal preventive pawl portion 34*c*. Also, when the toner cartridges TCy, TCm, TCc and TCk are mounted onto the image forming apparatus main body U1 as shown in FIG. 3, a waste developer delivery passage HGn (see FIG. 27 which will be discussed later) extending from the sensitive cleaners CLy, CLm, CLc and CLk and the like pushes the waste flow-in opening shutter 34 into the inside of the waste developer storage case 32 against the energizing force of the shutter spring 36, thereby allowing the waste developer to flow from the waste developer delivery passage HGh into the waste developer storage chamber 32*c*.

By the way, according to the embodiment 1, in the front surface of the flow-in opening shutter main body 34*a*, there is formed a guide recessed portion 34*a*1 which is composed of a circular-shaped recessed portion. The guide recessed portion 34*a*1 is contacted with a projecting portion (not shown) provided on the front end of the front end portion HGh1 of the waste developer delivery passage HGh to guide the front end portion HGh1 to the central portion of the flow-in opening shutter main body 34*a*. This can prevent the front end portion HGh1 of the waste developer delivery passage HGh from being shifted from the central portion of the flow-in opening shutter main body 34*a* due to the rickety motion thereof or the like. That is, the guide recessed portion 34*a*1 is formed in order to solve a technological problem to positively connect the developer delivery passage.

In FIGS. 4, 13A and 15, on the front surface of the waste developer storage case 32, at a position thereof that is situated inside the leakage preventive member protect rib 32*k* and surrounds the outer periphery of the waste developer flow-in opening 32*c*, there is fixedly supported a flow-in opening leakage preventive member 37. The flow-in opening leakage preventive member 37 according to the embodiment 1 is made of a so called sponge-like foaming material. According to the embodiment 1, in order to prevent the flow-in opening leakage preventive member 37 from being broken by the leakage preventive member protect rib 32*k*, the thickness of the flow-in opening leakage preventive member 37 is set equal to the amount of projection of the leakage preventive member protect rib 32*k*. That is, the leakage preventive member protect rib 32*k* is provided in order to solve a technological problem to prevent the breakage of the flow-in opening leakage preventive member 37.

Also, an opening 37*a*, which is formed in the elastic flow-in opening leakage preventive member 37, is formed smaller in diameter than the waste developer flow-in opening 32*j*. That is, in order to solve a technological problem to prevent the contamination due to the leakage of the developer, the opening 37*a* of the flow-in opening leakage preventive member 37 is formed smaller in diameter than the waste developer flow-in opening 32*j*.

(Description of Cartridge Operation Handle)

FIG. 21 is an explanatory view of a handle according to the embodiment 1. Specifically, FIG. 21A is a perspective view when it is viewed from right front obliquely above, FIG. 21B is a perspective view when it is viewed from left front obliquely below, FIG. 21C is a perspective view when it is viewed from left rear obliquely above, FIG. 21D is a perspective view when it is viewed from right rear obliquely above, FIG. 21E is a perspective view when it is viewed from front, FIG. 21F is a perspective view when it is viewed from the direction of the arrow mark XXIF shown in FIG. 21E, FIG. 21G is a perspective view when it is viewed from the direction of the arrow mark XXIG shown in FIG. 21E, FIG. 21H is a perspective view when it is viewed from the direction of the arrow mark XXIH shown in FIG. 21E, FIG. 21I is a perspective view when it is viewed from the direction of the arrow mark XXII shown in FIG. 21E, and FIG. 21J is a perspective view when it is viewed from the direction of the arrow mark XXIJ shown in FIG. 21I.

In FIGS. 4, 13 to 15 and 21, on the handle fixing portion 32*g* of the waste developer storage case 32, there is supported a handle 38 as an example of a hold member which a user holds when operating the toner cartridges TCy, TCm, TCc and TCk. The handle 38 includes a plate-shaped handle main body 38*a* as well as an upper end wall 38*b* and a right side wall 38*c* which are respectively formed on the upper end and right side of the handle main body 38*a* integrally therewith.

In the right side wall 38*c*, there is formed a hole-shaped display portion 38*c*1 for showing the relative positions of the toner cartridges TCy, TCm, TCc and TCk to their associated cartridge storage cases 4 (whether the toner cartridges TCy, TCm, TCc and TCk are present in front of or at the rear of their associated cartridge storage cases 4). Therefore, for example, suppose the handle 38 is colored with a color (for example, white) different from the color (for example, black) of the remaining members and a recess-like display portion is formed in the while handle. When compared with a case where the color of the display portion is the same as the color of the handle main body, the color of the remaining members disposed on the deep side can be seen through the hole-shaped display portion 38*c*1, so that a greater contrast can be obtained and thus it is easier to recognize the display portion. That is, the hole-shaped display portion 38*c*1 is formed in order to solve a technological problem to facilitate the visual confirmation of the display portion 38*c*1 by the user.

In the left end portion of the upper end wall 38*b*, there is formed a rotation center recessed portion 38*b*1 into which the upper rotation center portion 32*g*1 can be fitted. The handle main body 38*a* includes an elastically deformable arm-shaped lower rotation center forming portion 38*d* formed in the lower end portion thereof. In the rotation center forming portion 38*d*, there is formed a rotation center recessed portion 38*d*1 which is situated vertically downward of the rotation center recessed portion 38*b*1 and can be fitted with the lower rotation center portion 32*g*1. Therefore, the handle 38 is rotatably supported on the handle fix portion 32*g* by the rotation center portion 32*g*1 and rotation center recessed portions 38*b*1, 38*d*1. Also, in order to solve a technological problem to allow the handle 38 to be mounted onto the handle fix portion 32*g* easily, the elastically deformable rotation center forming portion 38*d* is formed and, when mounting the handle 38, the rotation center forming portion 38*d* is elastically deformed provisionally and is mounted onto the rotation center portion 32*g*1.

Figure 21A:
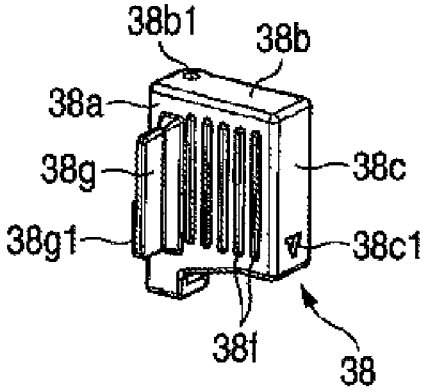
FIGS. 21A to 21J are explanatory views of a handle according to the exemplary embodiment 1, specifically.
Figure 21B:
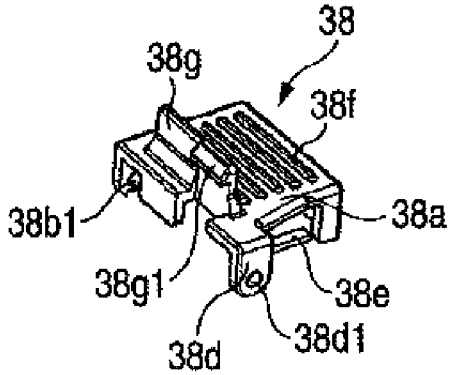
Figure 21C:
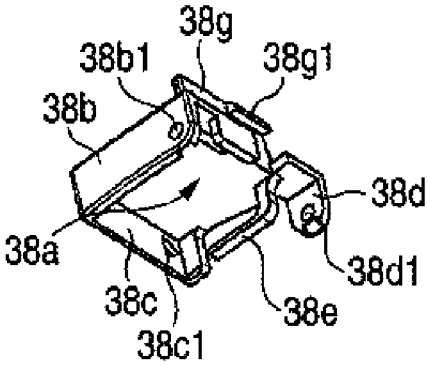
Figure 21D:
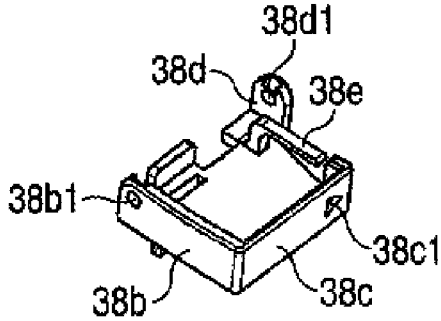
Figure 21G:
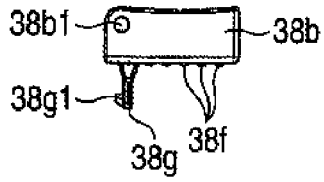
Figure 21H:
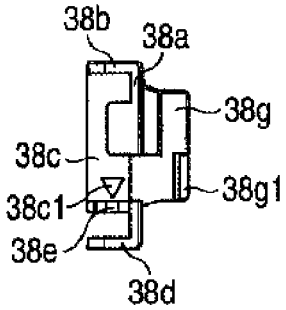
Figure 21E:
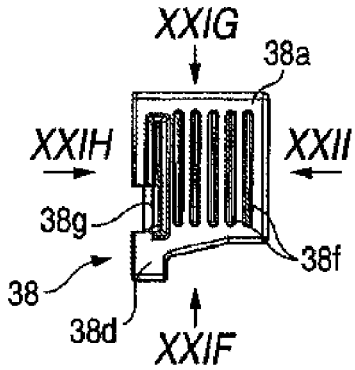
Figure 21I:
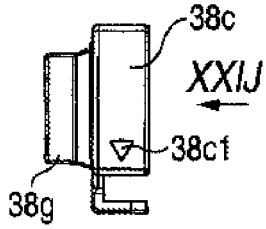
Figure 21F:
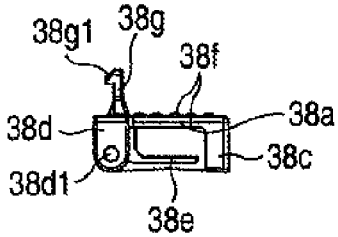
Figure 21J:
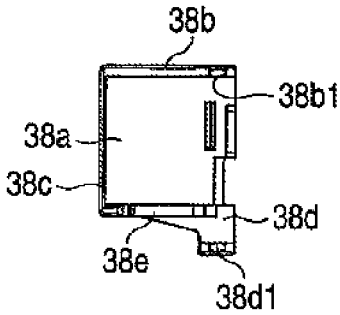
Figure 22A:
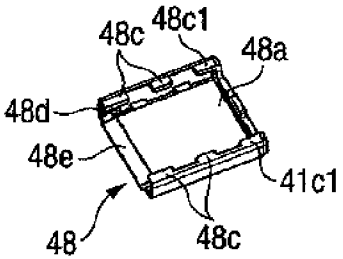
FIGS. 22A to 22H are explanatory views of a cartridge shutter according to the exemplary embodiment 1, specifically.
Figure 22B:
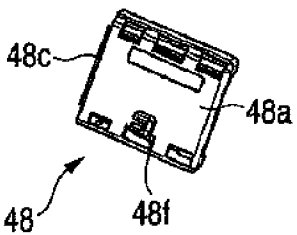
Figure 22H:
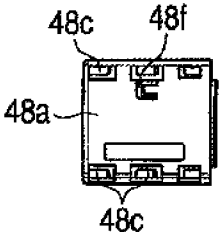
Figure 22G:
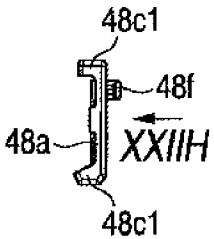
Figure 22D:
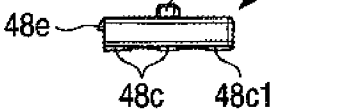
Figure 22C:
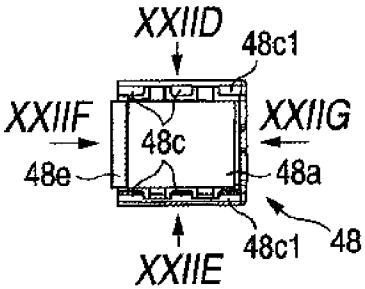
Figure 22E:
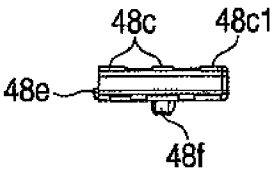
Figure 22F:
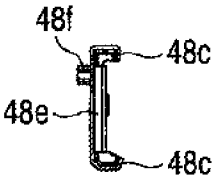

In FIGS. 21C and 21D, on the lower portion of the rear surface of the handle main body 38*a*, there is provided an elastically deformable plate spring portion 38*e*. The plate spring portion 38*e* is supported on the plate spring support portion 32*g*3 of the handle fix portion 32*g* in such a manner that the leading end portion of the plate spring portion 38*e* is in contact with the plate spring support portion 32*g*3. That is, in order to solve a technological problem to decrease the number of parts of the handle to thereby reduce the cost thereof and enhance the assembling efficiency thereof, the plate spring portion 38*e* is formed not as a separate member but is formed integrally with the handle 38.

On the front surface of the handle main body 38*e*, there is provided a slippage preventive uneven portion 38*f*. In the left portion of the front surface of the handle main body 38*e*, as an example of a mounting time engage and fix portion, there is formed an engage and fix portion 38*g* which projects forward. The engage and fix portion 38*g* includes an engaging pawl portion 38*g*1 which projects to the left and can be engaged with the lock portion 2*j* of the frame body 2.

Therefore, when a user holds the handle 38 while pinching the front surface of the handle and the rear surface of the handle fix portion 32*g*, the handle 38 is rotated and the plate spring portion 38*e* is elastically deformed and, when the user stops the holding of the handle 38, the handle 38 returns to its normal position shown in FIG. 13 due to its own elastic restoration. In FIG. 4, when the C color toner cartridge TCc is mounted, the handle 38 is returns to its normal position; and, therefore, the engaging pawl portion 38*g*1 is held in a state where it is engaged with the lock portion 2*j* and thus the movement of the toner cartridge TCc is regulated, that is, locked without holding the handle 38. On the other hand, when the handle 38 is rotated while pinching it, the engaging pawl portion 38*g*1 is removed from the lock portion 2*j* to thereby remove the locking of the toner cartridge TCc, thereby being able to move the toner cartridge TCc backwardly. That is, according to the embodiment 1, in order to solve a technological problem that an operator can mount and remove easily without reading an operation manual or the like in the mounting and removing operation, there is employed such shape for the handle 38 as allows the user to pinch and rotate the handle 38 between the handle 38 and handle fix portion 32*g*. Also, in order to solve a technological problem that, when the user wants to remove the toner cartridges TCy, TCm, TCc and TCk, they can be removed but, when not, they will not be removed, the handle 38 is structured such that, when the handle is pinched in order to push the toner cartridges TCy, TCm, TCc and TCk backward, the handle is rotated naturally and thus the locking of the toner cartridges is removed and, when not pinched, the toner cartridges are locked by the plate spring portion 38*e*.

In FIGS. 4, 13 and 15, on the CRUM mounting portion 32*h* of the waste developer storage case 32, there is removably supported a memory member 41, a so called a CRUM (Customer Replaceable Unit Memory) for storing information about the toner cartridges TCy, TCm, TCc and TCk, for example, information about whether they are have not been used, information about whether the developer stored in the toner cartridges have been emptied, or information about the accumulated time used of the toner cartridges. The memory member 41 includes a thin CRUM main body 41*a* which, while including a substrate therein, is guided by the memory member mounting guide 32*h*2 and is disposed inside the protect rib 32*h*1. That is, the protect rib 32*h*1 is provided in order to solve a technological problem to protect the memory member 41. Also, in order to solve a technological problem to be able to mount the memory member 41 easily, the memory member mounting guide 32*h*2 is provided and the CRUM main body 41*a* is formed thin in thickness.

Also, the memory member 41 includes a connector portion 41*b* which extends from the substrate; and, when mounting the toner cartridges TCy, TCm, TCc and TCk, the connector portion 41*b* is fitted with and connected to the CRUM connector portion 2*k* (see FIG. 6A) to thereby allow the writing of information or the like. On the rear end portion of the CRUM main body 41*a*, there is provided a pawl portion 41*c* which extends backwardly; and, the pawl portion 41*c* is fitted with the pawl engaging portion 32*h*3 and is thereby prevented against removal. And, when reusing the toner cartridges TCy, TCm, TCc and TCk, by removing the engagement between the pawl portion 41*c* and pawl engaging portion 32*h*3, the memory member 41 can be removed. That is, the pawl portion 41*c* and pawl engaging portion 32*h*3 are formed in order to solve a technological problem to be able to mount and remove the memory member 41 easily.

Figure 14F:
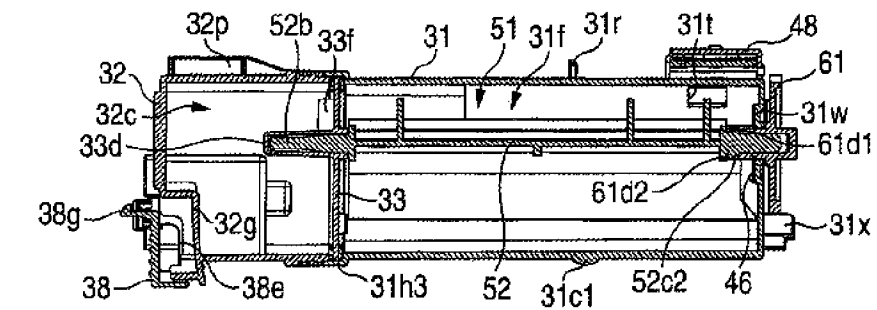

In FIGS. 14C, 14F and 15, on the seal member bonding portion 31*w* of the supply developer storage case 31, there is fixed and supported a circular-ring-shaped seal member 46 which prevents the developer from leaking from the supply developer storage space 31*f* through the shaft support hole 31*v*. That is, the base-shaped seal member bonding portion 31*w* is formed in order to solve a technological problem to facilitate the mounting of the circular-ring-shaped seal member 46.

In FIGS. 13 and 15, on the upper surface of the supply developer storage case 31, there is bonded an information stated member 47, a so called label on which information about the toner cartridges TCy, TCm, TCc and TCk is stated.

(Description of Cartridge Shutter)

FIG. 22 is an explanatory view of a cartridge shutter according to the embodiment 1. Specifically, FIG. 22A is a perspective view when it is viewed from obliquely above, FIG. 22B is a perspective view when it is viewed from obliquely below, FIG. 22C is a plan view, FIG. 22D is a view when it is viewed from the direction of the arrow mark XXIID shown in FIG. 22C, FIG. 22E is a view thereof when it is viewed from the direction of the arrow mark XXIIE shown in FIG. 22C, FIG. 22F is a view when it is viewed from the direction of the arrow mark XXIIF shown in FIG. 22C, FIG. 22G is a view when it is viewed from the direction of the arrow mark XXIIG shown in FIG. 22C, and FIG. 22H is a view when it is viewed from the direction of the arrow mark XXIIH shown in FIG. 22G.

In FIGS. 13 to 15 and 22, on the cartridge shutter guide portion 31*u* of the supply developer storage case 31, there is supported a cartridge shutter 48 so as to be slidable in the back and forth direction, as an example of a discharge opening opening/closing member for opening and closing the supply developer discharge opening 31*t*. The cartridge shutter 48 includes a shutter main body 48*a* and a rubber-made hermetically closing member, a so called seal member 48*b* bonded to the supply developer discharge opening 31*b* side of the shutter main body 48*a*.

In FIG. 22, on the right and left sides of the shutter main body 48*a*, as an example of an opening/closing member side guided portion, there are formed shutter guided portions 48*c* which are supported on the shutter guide portion 31*u*. In the rear end of the shutter main body 48*a*, there are formed engaging and regulating portions 48*c*1 which, in a state where the cartridge shutter 48 is closed, can be engaged with the end of the shutter guide portion 31*u* to regulate the movement of the cartridge shutter 48. On the front right side portion of the shutter main body 48*a*, there is provided a removal preventive projecting portion 48*d* made of a long and narrow projection which projects inwardly. The removal preventive projecting portion 48*d* can be fitted into the shutter removal preventive recessed portion 31*s*2 to thereby prevent the cartridge shutter 48 from being moved due to an unintentional external force. That is, in order to solve a technological problem to prevent the cartridge shutter 48 from moving unintentionally, or from slipping off from the shutter guide portion 31*u* (such slippage is the worst, if it occurs), there are formed the removal preventive projection portion 48*d* and shutter removal preventive recessed portion 31*s*2.

In the front end of the shutter main body 48*a*, as an example of an opening/closing member smoothly mounted portion, there is provided a shutter mounting guided portion 48*e* formed in a slope shape which slants as it goes forward. Therefore, owing to the cooperative operation of the shutter mounting guided portion 48*e* and shutter mounting guide portion 31*s*1, when the cartridge shutter 48 is mounted onto the shutter guide portion 31*u*, the former is difficult to be caught by the latter but can be mounted onto the latter smoothly and easily. That is, in order to solve a technological problem to be able to mount the cartridge shutter 48 easily, there are provided the shutter mounting guided portion 48*e* and shutter mounting guide portion 31*s*1.

On the lower surface of the shutter main body 48*a*, there is provided a fixing projection 48*f* which projects downwardly. When mounting the toner cartridges TCy, TCm, TCc and TCk, in a state where the cartridge storage cases 4 are rotated inwardly and are stored, the fixing projection 48*f* is fitted with the cartridge shutter fix portion 2*i* of the frame body 2 of the developer delivery device 1 to thereby regulate the movement of the cartridge shutter 48. Therefore, when the cartridge storage cases 4 are rotated inwardly and are stored, the fixing projection 48*c* is engaged with and fixed to the shutter fix portion 2*i* to thereby prevent the movement of the shutter 48 in the back and forth direction. In this state, when the toner cartridges TCy, TCm, TCc and TCk are slided, the supply developer discharge opening 31*t* is moved relative to the cartridge shutter 48, whereby the supply developer discharge opening 31*t* is opened and closed. That is, the shutter fix portion 2*i* and fixing projection 48*c* are provided in order to solve a technological problem to allow the relative movement between the cartridge shutter 48 and supply developer discharge opening 31*t* when mounting the toner cartridges TCy, TCm, TCc and TCk.

(Description of Delivery Member)

Figure 23A:
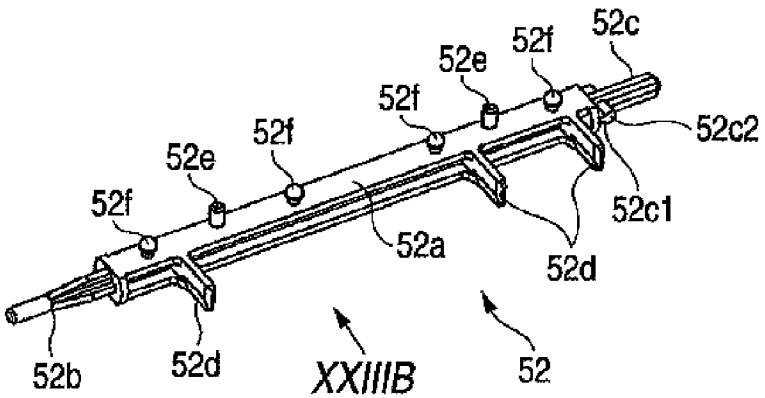
FIGS. 23A and 23B are explanatory views of the rotation shaft of an agitator as an example of a developer delivery member according to the exemplary embodiment 1, specifically.
Figure 23B:
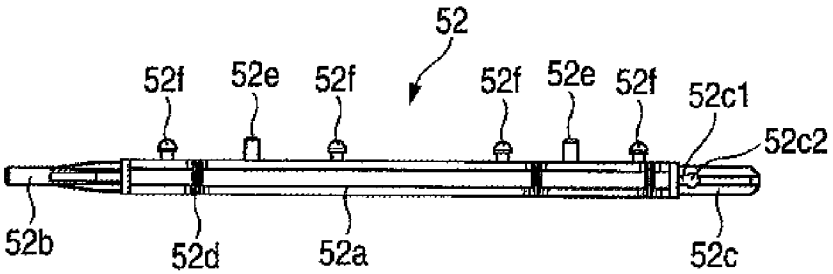

FIG. 23 is an explanatory view of the rotation shaft of an agitator as an example of a developer delivery member according to the embodiment 1. Specifically, FIG. 23A is a perspective view, and FIG. 23B is a side view when it is viewed from the direction of the arrow mark XXIIIB shown in FIG. 23A.

In FIGS. 9, 14 and 15, within the supply developer storage space 31*f*, there is rotatably supported an agitator 51 as an example of a developer delivery member. The agitator 51 includes a rotation shaft 52 longer than the length of the supply developer storage case 31 in the longitudinal direction thereof, and a film member 53 functioning as a delivery member main body supported on the rotation shaft 52. In FIG. 23, the rotation shaft 52 includes a rotation shaft main body 52*a* which extends in the longitudinal direction of the rotation shaft 52 and has a quadratic prism shape. The rotation shaft main body 52 includes, in the other end portion (the front end portion) thereof, the other end side portion to be supported 52*b* which can be fitted into the shaft insertion hole 33*e* of the partition member 33 and can be rotatably supported; and, the leading end of the other end side portion to be supported 52*b* is structured such that it becomes narrower as it goes forward for easy fitting into the shaft insertion hole 33*e*. That is, in order to solve a technological problem to enhance the efficiency of the operation to assemble the toner cartridges TCy, TCm, TCc and TCk, the rotation shaft 52 is formed so as to project outwardly from the opening 31*g* of the supply developer storage case 51 and the other end side portion to be supported 52 is formed in such a manner that the leading end side thereof becomes narrower, whereby the rotation shaft 52 can be easily mounted onto the partition member 33.

In one end portion (rear end portion) of the rotation shaft main body 52*a*, there is formed a one end side portion to be supported 52*c* which penetrates through the shaft support penetration hole 31*e* of the supply developer storage case 31 and projects outwardly. In the base end portion of the one end side portion to be supported 52*c*, there is formed a mounting portion 52*c*1. The mounting portion 52*c*1 includes a rearward extending portion 52*c*2 and a cylindrical portion 52*c*3 formed continuous with the rear end of the rearward extending portion 52*c*2.

In FIG. 23, on one side surface of the rotation shaft main body 52*a*, there are provided two or more agitate portions 52*d* which are projected outwardly and are used to agitate the developer. That is, the agitate portions 52*d* are provided in order to solve a technological problem to enhance the developer agitating performance of the agitator.

On the side surface of the rotation shaft main body 52*a* that is different from the agitate portions 52*d*, as an example of a delivery member main body positioning portion, there are provided two film positioning projecting portions 52*e*. On the right and left sides of each film positioning projecting portion 52*e*, there are provided film fix portions 52*f* as an example of a delivery member main body fix portion formed to have a mushroom shape.

Figure 24:
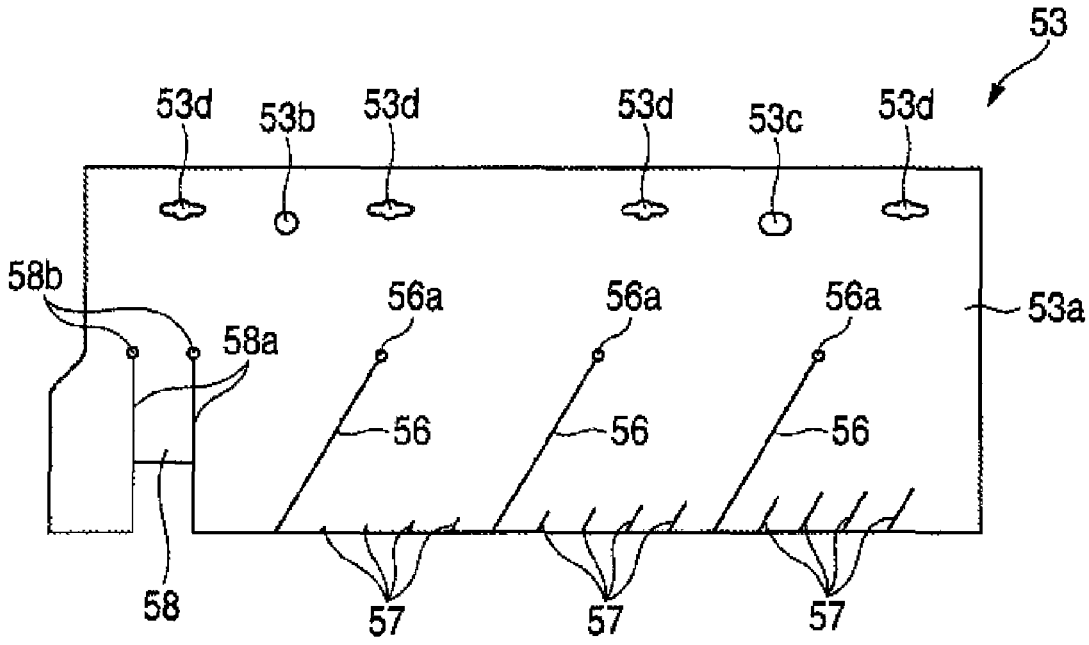
FIG. 24 is an explanatory view of a film member as an example of a delivery member main body of an agitator according to the exemplary embodiment 1.
Figure 25B:
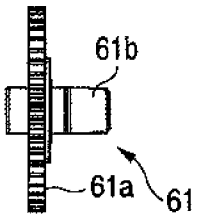
FIGS. 25A to 25E are six views of a cartridge gear as an example of a delivery member drive transmission member according to the exemplary embodiment 1, specifically.
Figure 25A:
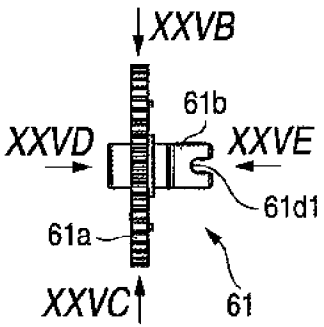
Figure 25C:
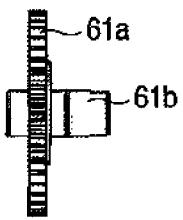
Figure 25D:
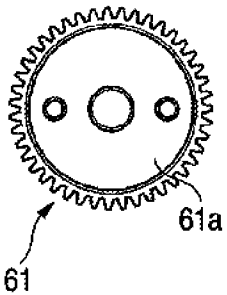
Figure 25E:
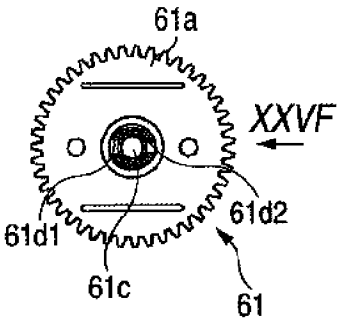
Figure 25F:
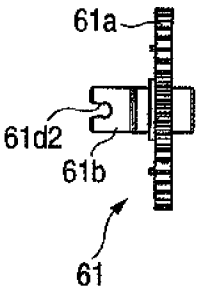
FIG. 25F is a view when viewed from the direction of the arrow mark XXVF shown in FIG. 25E.

FIG. 24 is an explanatory view of a film member as an example of the delivery member of the agitator according to the embodiment 1.

In FIGS. 9, 14, 15 and 24, the film member 53 includes a rectangular thin film shaped film main body 53*a*. According to the embodiment 1, in order to solve a technological problem to reduce the cost of the film member 53, the film member 53 is made of a PET film of low cost. Also, in order to solve a technological problem that the film member can be rotated in contact with the inner peripheral surface of the supply developer storage case 31, while being flexed, to agitate and deliver the developer efficiently, according to the embodiment 1, there is used a film having a thickness of the order of 100 μm. By the way, when the film is too thin, the film is too soft and thus the force of the film to press against the developer and agitate it is too weak; and, when the film is too thick, there is produced noise.

In the base end portion of the film main body 53*a* that is supported by the rotation shaft 52, there are formed two positioning holes 53*b* and 53*c* which respectively correspond to their associated film positioning projecting portions 52*e* of the rotation shaft 52. The two positioning holes 53*b* and 53*c* are structured such that, for the positioning purpose, one is formed as a round hole 53*b* and the other is formed as an elongated hole 53*c*. On both sides of the respective positioning holes 53*b* and 53*c*, there are formed two fixed holes 53*d* in such a manner that they correspond to the arranging positions of the film fix portion 52*f*. The fixed hole 53*d* is formed in a shape which has a round hole in the central portion of a slit; and, when it penetrates through the film fix portion 52*f*, it passes there while being elastically deformed and, after it has passed there, it is prevented against removal by the mushroom shaped leading end portion of the film fix portion 52*f*. Referring here to the structures of the positioning holes 53*b*, 53*c*, fixed holes 53*d*, film positioning projecting holes 52*e* and film fix portions 52*f*, in order to prevent the reverse mounting of the film member 53 onto the rotation shaft 52, the axial-direction arrangement distances between the positioning hole 53*b*, positioning hole 53*c* and fixed holes 53*d* are all set different from each other. That is, the positioning holes 53*b*, 53*c*, fixed holes 53*d*, film positioning projecting holes 52*e* and film fix portions 52*f* are arranged in order to solve a technological problem to prevent the wrong assembling of the rotation shaft 52 and film member 53.

In the edge portion of the film main body 53*a* on the free end portion side thereof, there are formed at given intervals two or more main delivery cut portions 56 which respectively slant backwardly, that is, toward the supply developer discharge opening 31*t*. In the base end side end portion of the main delivery cut portion 56, there is formed a round-hole-shaped cut growth preventive portion 56*a* which is used to prevent the cut portion from growing during use. Between the main delivery cut portions 56, there are formed two or more sub delivery cut portions 57. The sub delivery cut portions 57 are structured such that they become larger as they are more distant from the supply developer discharge opening 31*b*. That is, in order to solve a technological problem that the developer stored in the supply developer discharge space 31*f* can be delivered efficiently toward the supply developer discharge opening 31*t*, there are formed the sub delivery cut portions 57 which become larger as they are more distant from the main delivery cut portions 56 and discharge opening 31*t*.

In the position of the film main body 53*a* that corresponds to the supply developer discharge opening 31*t* along the axial direction of the rotation shaft 52, there is formed a clogging preventive portion 58. According to the embodiment 1, the clogging preventive portion 58 is constituted by a portion which is surrounded by a pair of cut portions 58*a* respectively formed along the diameter direction of the rotation shaft 52; and, in the base end side end portions of the cut portions 58*a* of the clogging preventive member 58 as well, there are formed cut growth preventive portions 58*b* respectively. With the rotation of the rotation shaft 52, the clogging preventive portion 58 moves periodically into the supply developer discharge opening 31*t* to tear down the developer adherent to the supply developer discharge opening 31*t*. That is, the clogging preventive portion 58 is provided in order to solve a technological problem that the supply developer discharge opening 31*t* is prevented from being clogged with developer discharged from the gravity direction to the slanting side direction to thereby stabilize the supply of the developer.

Also, in order to solve a technological problem to eliminate a possibility that, in rotation, the cut portion is caused to grow due to the force received from the developer to thereby break the film member 53, the cut growth preventive portions 56*a* and 58*b* are respectively formed in the main delivery portion 56 and clogging preventive portion 58 which are large in the cut size and thus are liable to receive a large force.

According to the embodiment 1, the film main body 53*a* is set to have such a free length that allows it to rotate in contact with the inner peripheral surface of the supply developer storage space 31*f* while being flexed. Also, the clog preventive portion 58 rotates in contact with the inner peripheral surface of the supply developer storage space 31*f* while being flexed and the free length of the preventive portion 58 is set shorter than those of the other portions of the film main body 53*a*.

Here, as shown in FIG. 9, in the case of the agitator 51 according to the embodiment 1, since the shaft support penetration hole 31*e* and shaft insertion hole 33*e* are formed not in the central portion of the flat-shaped supply developer storage space 31*f* but in the positions that are shifted to the supply developer discharge opening 31*t*, the rotation shaft 52 is disposed at a position shifted to the supply developer discharge opening 31*t*. Therefore, the rotation shaft 52 of the agitator 51 receives a force from the flexed film member 53. At the then time, the rotation shaft 52 of the agitator 51 is rotatably supported on the rear end portion thereof in a cantilevered manner; and, to the front end portion thereof that is the free end portion thereof, there is applied a force which goes in the axial direction within a horizontal surface, whereby the front end portion of the rotation shaft 52 is caused to press the partition member 33 against the inner wall of the supply developer storage case 31 at right angles. Therefore, when the supply developer storage case 31 and waste developer storage case 32 are removed from each other, owing to the pressing force of the partition member 33 and the high friction resistance of the seal portions 33*b*, 33*c*, there can be reduced the possibility that the partition member 33 can be naturally removed from the supply developer storage case 31.

FIG. 25 is six views of a cartridge gear as an example of a delivery member drive transmission member according to the embodiment 1. Specifically, FIG. 25A is a side view, FIG. 25B is a view when it is viewed from the direction of the arrow mark XXVB shown in FIG. 25A, FIG. 25C is a view when it is viewed from the direction of the arrow mark XXVC shown in FIG. 25A, FIG. 25D is a view when it is viewed from the direction of the arrow mark XXVD shown in FIG. 25A, FIG. 25E is a view when it is viewed from the direction of the arrow mark XXVE shown in FIG. 25A, and FIG. 25F is a view when it is viewed from the direction of the arrow mark XXVF shown in FIG. 25E.

In FIGS. 13 to 15 and 25, in the rear end of the supply developer storage case 31, as an example of a delivery member drive transmission member, a cartridge gear 61 is mounted on the rear end portion of the one end side supported portion 52*c* of the rotation shaft 52 that projects rearward. In FIG. 25, the cartridge gear 61 includes a disk-shaped gear main body 61*a* with gear teeth formed on the outer periphery thereof, and a portion to be mounted 61*b* which projects forward from the central portion of the gear main body 61*a*.

The portion to be mounted 61*b* includes in the interior thereof a penetration hole 61*c* through which the one end side portion to be supported 61*c* can penetrate. The portion to be mounted 61*b* also includes in the front end portion thereof a pair of recessed portions to be mounted 61*d* which extends rearward. Each recessed portion to be mounted 61*d* includes a mounting guide portion 61*d*1 which guides the rearward extending portion 52*c*2 and cylindrical portion 52*c*3 and is fitted with them, and a mounting and fixing portion 61*d*2 having a narrow width portion smaller in width than the cylindrical portion 52*c*3. Therefore, when the mounting portion 52*c*1 of the rotation shaft 52 is matched to the pair of recessed portions to be mounted 61*d*, the rotation shaft 52 can be in phase with the cartridge gear 61. That is, in order to solve a technological problem to mount the agitator 51 in such a manner that it is in given phase, there are formed the recessed portions to be mounted 61*d* and mounting portion 52*c*1.

Also, in a state where the rotation shaft 52 is in phase with cartridge gear 61, when any one of the mounting portions 52*c*1 of the one end side portion to be supported 52*c* is pushed into the mounting and fixing portion 61*d*2, that is, the former is so called snap fitted into the latter, the agitator 51 can be fixed. In other words, in order to solve a technological problem to be able to easily mount and fix the agitator 51 onto the cartridge gear 61 with a small force, not only the rotation shaft 52 is structured such that, on both sides thereof, there are formed the rearward extending portion 52*c*2 and cylindrical portion 52*c*3 for snap fit fixation, whereby the rotation shaft 52 can be engaged with the cartridge gear 61 on both sides thereof; but also, the cartridge gear 61 is structured such that the mounting and fixing portion 61*d*2 for snap fit fixation is formed only on one side thereof.

In a state where the toner cartridges TCy, TCm, TCc and TCk are mounted, the cartridge gear 61 is meshingly engaged with the cartridge drive gear 20*a* and a drive force is transmitted to the cartridge gear 61, whereby the agitator 51 can be driven and rotated.

(Description of Method for Mounting Toner Cartridge)

FIG. 26 is an explanatory view to show how to mount a toner cartridge according to the embodiment 1. Specifically, FIG. 26A is an explanatory view to show the middle state of a step of mounting the toner cartridge into its associated cartridge storage case or removing the former from the latter, FIG. 26B is an explanatory view to show a state where the toner cartridge has been inserted into the deep portion of the cartridge storage case, FIG. 26C is an explanatory view to show a state where the cartridge storage case has been rotated inside and stored into the cartridge mounting portion, and FIG. 26D is an explanatory view to show a state where the toner cartridge has been moved forward from the state shown in FIG. 26C to its mounting position.

In FIGS. 1, 3, 4 and 26A, when mounting a new toner cartridge TCy, TCm, TCc and TCk, in a state where the side cover U3 is opened, the toner cartridge TCy, TCm, TCc and TCk is inserted in a state where the cartridge storage case 4 is rotated obliquely. At the then time, while the rib to be guided 31*n* provided on the bottom portion of the toner cartridge TCy, TCm, TCc and TCk is guided by the guide rib 4*b* of the cartridge storage case 4, the toner cartridge TCy, TCm, TCc and TCk is inserted into a given position.

Figure 26A:
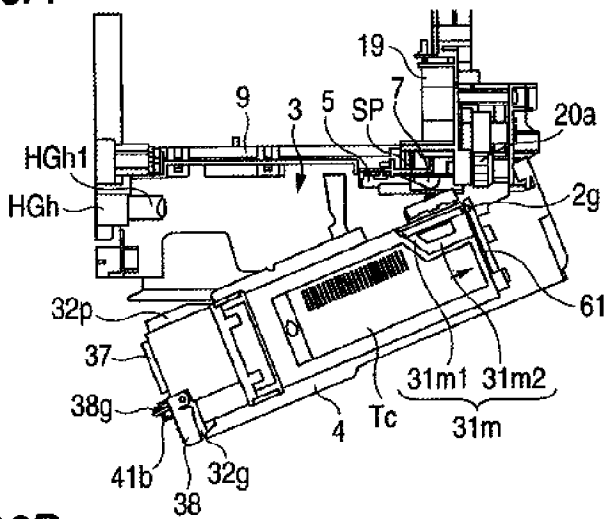
FIGS. 26A to 26D are explanatory views to show how to mount a toner cartridge according to the exemplary embodiment 1, specifically.
Figure 26B:
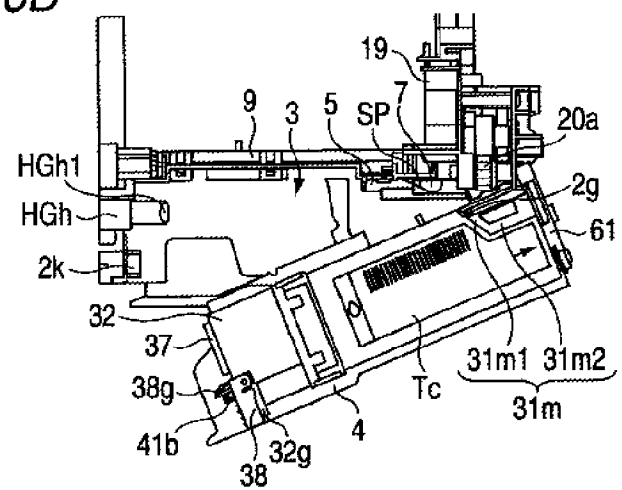

In FIG. 26B, when the toner cartridge TCy, TCm, TCc and TCk is inserted into the inmost portion of the cartridge storage case 4, the mounting sense operation engaging portion 32*c*1 is contacted with the mounting sense operation portion 4*d* to thereby provide a mounting sense and, at the same time, the mounting time positioned portion 31*k* is fitted into the positioning cut-away portion 4*c*, thereby completing the insertion of the toner cartridge. At the then time, the rotation regulate portion 2*g* of the frame body 2 passes above the member pass portion 31*p* and arrives at the front end portion of the slanting portion 31*m*1 of the mounting position rotation regulated portion 31*m*.

Figure 26C:
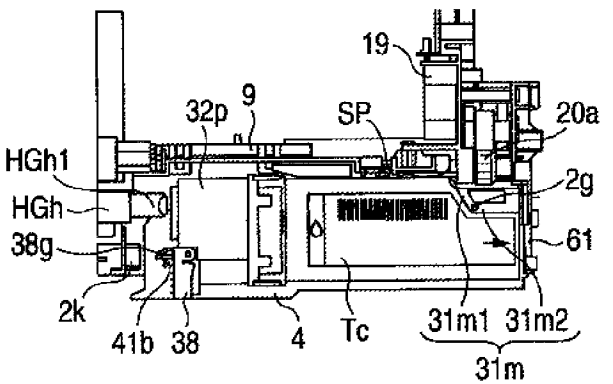

When a user pushes the cartridge storage case 4 to rotate it inside from the state shown in FIG. 26B, as shown in FIG. 26C, the cartridge storage case 4 is stored into the cartridge mounting portion 3 against the force of the plate spring SP in contact with the left wall portion 31*d* of the toner cartridge TCy, TCm, TCc and TCk.

At the then time, the rotation regulate portion 2*g* moves into the slanting portion 31*m*1 of the mounting position rotation regulated portion 31*m* and arrives at the connecting portion between the slanting portion 31*m*1 and rearward extending portion 31*m*2. Also, the cartridge gear 61 of the toner cartridge TCy, TCm, TCc and TCk is situated at the rear of the cartridge drive gear 20*a*. Further, the fixing projection 48*f* of the cartridge shutter 48 is fitted into the cartridge shutter fix portion 2*i*, thereby regulating the back and forth direction movement of the cartridge shutter 48.

Also, at a storage position shown in FIG. 26C, the shutter moving projection 31*r* of the toner cartridge TCy, TCm, TCc and TCk presses against the shutter lock portion 5*b* inside to deform it elastically, thereby removing the locking of the main body side shutter 7. That is, according to the present embodiment, in order to solve a technological problem to prevent the main body shutter from being opened in an unintentional condition, there are provided the shutter lock portion 5*b* and shutter moving projection 31*r*, whereby, when mounting the toner cartridge TCy, TCm, TCc and TCk, the locking of the main body shutter 7 can be removed.

Figure 26D:
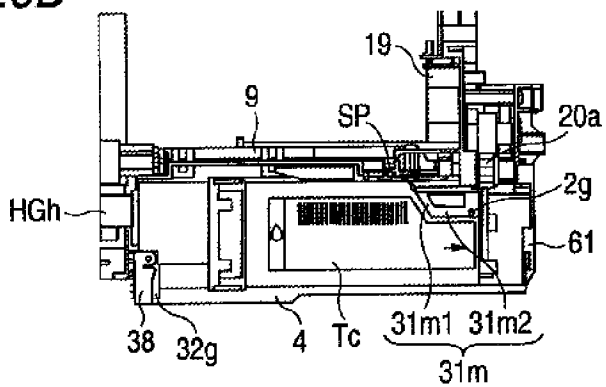

In a state shown in FIG. 26C, when the user puts a finger into the operation space 38*g*4 of the toner cartridge TCy, TCm, TCc and TCk and pushes forward the rear surface of the handle fix portion 32*g* which is prevented against slippage by the slippage preventive uneven portion 32*g*2, as shown in FIG. 26D, the toner cartridge TCy, TCm, TCc and TCk is moved to the forward mounting position. Since the toner cartridge TCy, TCm, TCc and TCk is moved in a state where the movement of the cartridge shutter 48 is regulated by the fixing projection 48*f*, the supply developer discharge opening 31*t* of the toner cartridge TCy, TCm, TCc and TCk is opened. At the then time, in a state where the locking of the main body side shutter 7 is removed by the shutter moving projection 31*r*, the main body side shutter 7 is pushed by the front end portion of the discharge opening forming portion 31*s* of the forward moving toner cartridge TCy, TCm, TCc and TCk and is thereby slided forward, so that the flow-in opening 6 is also opened. Thus, the supply developer discharge opening 31*t* of the toner cartridge TCy, TCm, TCc and TCk is connected to the flow-in opening 6.

When the toner cartridge TCy, TCm, TCc and TCk moves to the forward mounting position, the rotation regulate portion 2*g* is situated at the rear end portion of the rearward extending portion 31*m*2 and the rotation regulate portion 2*g* is regulated in such a manner that the movement thereof in the right and left direction is prevented by the rearward extending portion 31*m*2. Owing to this, the rotation of the rear end portion of the toner cartridge TCy, TCm, TCc and TCk is prevented against the force of the plate spring to move the cartridge storage case 4 outward. Therefore, as shown in FIGS. 26B to 26D, the rotation regulate portion 2*g* is set such that it can be moved following a locus along the slanting portion 31*m*1 and rearward extending portion 31*m*2 of the mounting position rotation regulated portion 31*m*. That is, according to the embodiment 1, in order to solve a technological problem to eliminate the possibility that the toner cartridge TCy, TCm, TCc and TCk can rotate outward in an unintentional condition to thereby remove the connection between the flow-in opening 6 and supply developer discharge opening 31*t*, there are provided the rotation regulate portion 2*g* and mounting position rotation regulated portion 31*m*.

Also, when the toner cartridge TCy, TCm, TCc and TCk moves from the insertion position shown in FIG. 26C to the mounting position shown in FIG. 26D, the cartridge gear 61 meshes with the cartridge drive gear 20*a* and thus it is supported in such a manner that a drive force can be transmitted thereto from the cartridge drive gear 20*a*. At the then time, owing to the member pass portion 31*p*, the cartridge drive gear 20*a* is allowed to mesh with the cartridge gear 61 without touching or interfering the supply developer storage case 31.

Further, when the toner cartridge TCy, TCm, TCc and TCk moves forward, the front side portion to be guided 32*p* of the toner cartridge TCy, TCm, TCc and TCk is fitted with the front side guide portion 2*m* of the frame body 2, so that the toner cartridge TCy, TCm, TCc and TCk can be guided to a given position in such a manner that it shakes less. Also, in a state where the toner cartridge TCy, TCm, TCc and TCk has been moved to the mounting position, owing to the mutual engagement between the front side guide portion 2*m* and front side portion to be guided 32*p*, the movement of the toner cartridge TCy, TCm, TCc and TCk in the right and left direction is prevented, which prevents the rotation of the front side of the toner cartridge TCy, TCm, TCc and TCk. That is, according to the embodiment 1, the front side guide portion 2*m* and front side portion to be guided 32*p* are provided in order not only to attain an object to guide the toner cartridge TCy, TCm, TCc and TCk with good linearity but also to solve a technological problem to prevent the toner cartridge TCy, TCm, TCc and TCk from rotating outward in an unintentional condition and thus prevent the connection between the flow-in opening 6 and supply developer discharge opening 31*t* from being removed.

Also, at the then time, in the waste developer storage case 32, the flow-in shutter 34 is pushed by the waste developer delivery passage HGn and is thereby moved inside, whereby the waste developer is allowed to flow into the waste developer storage space 32*c*. In this case, the waste developer delivery passage HGn is positively guided to the flow-in opening shutter 34 due to the guide recessed portion 34*a*1, thereby connecting together the waste developer delivery passage HGn and waste developer storage space 32*c*.

Also, when the toner cartridge TCy, TCm, TCc and TCk moves forward, the engage pawl portion 38*g*1 of the engage and fix portion 38g of the toner cartridge TCy, TCm, TCc and TCk touches the frame body main body 2a before the lock portion 2j and the handle 38 is thereby rotated; and, after then, when the engage pawl portion 38g1 reaches the position of the lock portion 2j, the engage pawl portion 38g1 is returned due to the plate spring portion 38e and is thereby engaged with the lock portion 2j. This prevents the toner cartridge TCy, TCm, TCc and TCk against movement in the back and forth direction, that is, the toner cartridge TCy, TCm, TCc and TCk is locked. Therefore, the toner cartridge TCy, TCm, TCc and TCk according to the embodiment 1, at the mounting position, is locked in the back and forth direction as well as in the right and left direction. As regards the movement of the toner cartridge TCy, TCm, TCc and TCk in the vertical direction, since it is stored within the cartridge storage case, it cannot be taken out in the vertical direction.

Further, when the toner cartridge TCy, TCm, TCc and TCk moves forward, the connector portion 41b is connected to the CRUM connector portion 2k, thereby being able to read and update the information that is stored in the memory member 41.

(Description of Method for Removing Toner Cartridge)

In FIG. 26D, in an operation to remove the toner cartridge TCy, TCm, TCc and TCk, when a user pinches the handle 38 in order to remove the toner cartridge TCy, TCm, TCc and TCk, the handle 38 is rotated and the engage pawl portion 38g1 is removed from the lock portion 2j to thereby remove the locking of the toner cartridge TCy, TCm, TCc and TCk. Owing to this, the toner cartridge TCy, TCm, TCc and TCk is held in a state where it can be moved backward and thus, while pinching the handle 38, the user can push and move the toner cartridge TCy, TCm, TCc and TCk backward. When the toner cartridge TCy, TCm, TCc and TCk moves backward, the engagement and connection of the cartridge gear 61, waste developer delivery passage, connector portion 41b and the like are removed.

At the then time, the main body side shutter 7 is pushed by the shutter moving projection 31r of the toner cartridge TCy, TCm, TCc and TCk and is thereby moved backward, so that the flow-in opening 6 is closed. Also, since the toner cartridge TCy, TCm, TCc and TCk is moved backward with respect to the unmovable cartridge shutter 48, the supply developer discharge opening 31t is also closed.

When the toner cartridge TCy, TCm, TCc and TCk moves from the mounting position shown in FIG. 26D to the mounting position shown in FIG. 26C, the front side guide portion 2m and front side portion to be guided 32p are separated from each other. Also, the rotation regulate portion 2g is moved to the connecting portion between the slanting portion 31m1 and rearward extending portion 31m2. Therefore, in this state, since the prevention of the rotation of the toner cartridge TCy, TCm, TCc and TCk not only by the front side guide portion 2m and front side portion to be guided 32p but also by the rotation regulate portion 2g and mounting position rotation regulated portion 31m is removed, due to the spring force of the plate spring SP, the toner cartridge TCy, TCm, TCc and TCk is automatically moved to the insertion position shown in FIG. 26B which is the position where the cartridge storage case 4 is rotated outside. That is, according to the embodiment 1, in order to solve a technological problem to facilitate the toner cartridge removing operation, there is provided the plate spring SP.

In the insertion position shown in FIG. 26B, the toner cartridge TCy, TCm, TCc and TCk can be inserted and extracted and, therefore, the toner cartridge TCy, TCm, TCc and TCk can be pulled out from the cartridge storage case and can be removed therefrom.

(Method for Reusing Toner Cartridge)

In FIGS. 13 to 15, to recycle or reuse a used toner cartridge TCy, TCm, TCc and TCk, firstly, the tape TP of the toner cartridge TCy, TCm, TCc and TCk is unwound and taken away to thereby remove the connection between the connecting hole 31j and pawl portion 32e. At the then time, since the waste developer is stored in the waste developer storage space 32c, by removing the toner cartridge TCy, TCm, TCc and TCk with the waste developer storage case 32 facing downward in the gravity direction, the developer of the waste developer storage case 32 is prevented from leaking from the waste developer storage case 32. In this case, since the pressing force of the film member 53 reduces the possibility of the partition member 33 being removed outward, there can be reduced the possibility that, in a state where a small amount of developer remains in the supply developer storage space 31f, unintentionally, the partition member 33 can be removed to thereby allow the developer to leak out of the supply developer storage space 31f. After the waste developer storage case 32 is removed, in a state where the supply developer storage case 31 is set downward of the partition member 33, when the partition member 33 is removed in such a manner that it is pulled out in the axial direction of the rotation shaft 52, the developer remaining in the supply developer storage space 31f can be prevented against leakage. Next, when the snap-fit mounted agitator 51 is removed, the toner cartridge TCy, TCm, TCc and TCk can be decomposed. After decomposition, the respective composing members of the toner cartridge TCy, TCm, TCc and TCk are cleaned. Then, after the agitator 51 is mounted, a new developer is stored into the supply developer storage space 31f, the partition member 33 and waste developer storage case 32 are mounted sequentially, and the tape TP is wound on the toner cartridge TCy, TCm, TCc and TCk, whereby the toner cartridge TCy, TCm, TCc and TCk can be reused.

Operation of Embodiment 1

In the printer U as an example of an image forming apparatus having the above-mentioned structure according to the embodiment 1, when the toner of the developing device Gy, Gm, Gc and Gk is consumed due to the image forming operation, the developer of the supply developer storage space 31f of the toner cartridge TCy, TCm, TCc and TCk is supplied from the flow-in opening 6. At the then time, with the image forming operation, the waste developer collected by the image holder cleaner CLy, CLm, CLc and CLk is collected into the waste developer storage space 32c.

In the toner cartridge TCy, TCm, TCc and TCk, the developer collected into the supply developer storage case 31 having a flat shape is prevented from generating a so called blocking phenomenon in which the developer hardens or blocks due to its own weight and, at the same time, when the developer is agitated by the agitator 51, the block state of the developer can be broken easily and positively. Also, since the agitator 51 is structured such that the cartridge gear 61 is supported on the rear end thereof and the supply developer discharge opening 31t is formed on the rear end side thereof, the twisting and vibration of the rotation shaft 52 of the agitator 51 can be reduced in the drive transmission time, which can stabilize the discharge of the developer from the toner cartridge TCy, TCm, TCc and TCk to the developer delivery device 1. Since the center of rotation of the agitator 51 is shifted from the center thereof, the distance between the center of rotation and the inner peripheral surface of the supply developer storage space 31f varies with the rotation of the agitator 51 and the sagging of the film member 53 varies.

Owing to the variations in the flexing motion of the film member 53, the film member 53 is allowed to leap or bounce within the supply developer storage space 31*f*, the agitation performance of the developer can be enhanced, the block state of the developer can be reduced, and the supply of the developer can be stabilized. Especially, since the supply developer storage space 31*f* formed within the supply developer storage case 31 according to the embodiment 1 is formed to have a substantially square-shaped section, the film member 53 is able to bounce greatly within the supply developer storage space 31*f*.

Also, since the supply developer storage space 31*f* the other end side, that is, the front side of the rotation shaft 52 of the agitator 51 is supported by the partition member 33, the deviation of the rotation shaft 52 is reduced when compared with a structure where the other end side of the rotation shaft 52 is not supported, thereby being able to stabilize the supply of the developer. Further, since the clogging preventive portion 58 moves into the supply developer discharge opening 31*t* periodically, the supply developer discharge opening 31*t* disposed in the lateral side of the supply developer storage case 31 is difficult to be clogged with the developer, which can stabilize the supply of the developer. Also, since the clogging preventive member 21 moves into the flow-in opening 6 periodically, the laterally disposed flow-in opening 6 is difficult to be clogged with the developer, thereby being able to stabilize the supply of the developer.

Further, in the printer U according to the embodiment 1, when the toner cartridge TCy, TCm, TCc and TCk is decomposed, the possibility of the partition member 33 being removed due to its own weight is reduced by the pressing force of the film member 53 and, in a state where the developer remains in a small amount in the supply developer storage space 31*f*, there is reduced the possibility that the partition member 33 can be removed to thereby allow the developer to leak from the supply developer storage space 31*f* unintentionally. When removing the partition member 33 from the supply developer storage case 31, by extracting the partition member 33 in the axial direction of the rotation shaft 52 with the supply developer storage case 31 held downwardly of the partition member 33, the partition member 33 can be removed easily.

By the way, according to the embodiment 1, since the rotation shaft 52 is longer than the supply developer storage case 31 and projects outward from the opening 31*g*, the rotation shaft 52 is distant from the shaft support hole 31*v* which does not vary in position, whereby the vibration of the rotation shaft 52 increases and the pressing force thereof increases. That is, the force, with which the partition member 33 is pressed against the supply developer storage case 31, increases, thereby making it difficult for the partition member 33 to be removed from the supply developer storage case 31.

(Modification)

Although the embodiment of the invention has been described heretofore in detail, the invention is not limited to the embodiment but various changes and modifications are possible without departing from the scope of the subject matter of the invention as set forth in the scope of the patent claims. The modifications of the invention (H01 to H09) are as follows.

(H01) In the above-mentioned embodiment, there is illustrated a printer functioning as an image forming apparatus. However, the invention is not limited to this but it is also possible to employ a FAX, or a copying machine, or a composite machine having all functions of them or two or more functions. Also, the invention is not limited to an image forming apparatus capable of developing multiple colors but there can also be employed an image forming apparatus capable of developing a single color, that is, a so called monochrome. Also, the invention is not limited to a structure in which an image is transferred from an image holder to a medium, but the invention can also be applied to a structure using an intermediate transfer member.

(H02) In the above embodiment, when the clogging state is hard to occur, the clogging preventive members 21, 58 can be omitted.

(H03) In the above embodiment, there is illustrated a developer storage case which includes both the supply developer storage case 31 and waste developer storage case 32. However, this is not limitative but the waste developer storage case 32 may be omitted or may be structured as a separate unit.

(H04) In the above embodiment, although the developer delivery passage 11 is curved, it may also be structured to be linear. In this case, the developer delivery member 17 may not be made of flexible resin material but may also be made of high rigidity material.

(H05) In the above embodiment, there is illustrated a structure in which the toner flows in a slanting direction near to the horizontal direction through the flow-in opening 6. However, this is not limitative but there may also be employed a structure in which the toner flows in the gravity direction or in a slanting direction near to the gravity direction.

(H06) In the above embodiment, there is illustrated a gear as a drive transmission member. However, this is not limitative but it is also possible to use a conventionally known drive transmission member such as a so called coupler (coupling).

(H07) In the above embodiment, the rotation shaft 52 may preferably be disposed at a position shifted to the discharge opening 31*t* but may also be disposed in the central portion.

(H08) In the above embodiment, there is employed a structure in which there can be mounted and removed the visible image forming devices UY to UK each including an image holder cartridge and a developing cartridge. However, this is not limitative but, for example, it is also possible to employ a structure in which only the image holder cartridge can be mounted and removed but the developing device is fixed to the main body of the image forming apparatus, or a structure in which the visible image forming devices UY to UK are all fixed to the apparatus main body.

(H09) In the above embodiment, there may also be employed a structure in which there is provided a sensor for detecting the rotation position of the agitator 51 and, when the image forming apparatus is kept in a warehouse or when the image forming operation is ended, the image forming apparatus is held in a state where the clogging preventive member 58 is held within the developer discharge opening 31*t*. According to this structure, not only the developer is difficult to block in the developer discharge opening 31*t* but also, if blocked, the blocked developer is easy to break.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developer storage case comprising:

a storage case that includes a discharge opening formed in a horizontally facing side surface of the storage case, the storage case being formed in a flat shape having a horizontal direction width of larger than the vertical direction height thereof and storing a developer therein;

a delivery member that has a center of rotation disposed between a center of the storage case and discharge opening, that is rotatably supported on one end wall of the storage case, and that delivers the developer stored within the storage case; and a drive transmission member that is supported on an end portion of the delivery member, and that drives and rotates the delivery member, wherein the storage case defines an opening on an end side thereof opposite to an end side of the one end wall thereof, and another end side support member closes the opening and rotatably supports another end portion of the delivery member, wherein the opening has a substantially rectangular shape.

2. The developer storage case as claimed in claim 1, wherein the discharge opening is formed in the vicinity of the drive transmission member.

3. The developer storage case as claimed in claim 1, wherein the delivery member includes a rotation shaft and a flexible delivery member main body in contact with an inner peripheral surface of the storage case.

4. The developer storage case as claimed in claim 3, wherein as the rotation shaft is rotated, the flexible delivery member main body comes into contact with an upper portion, a left side portion, a bottom portion, and a right side portion of the inner peripheral surface of the storage case.

5. The developer storage case as claimed in claim 1, wherein the storage case has an arc-shaped part on a periphery of the discharge opening, a center of the arc-shaped part corresponds to the center of rotation of the delivery member.

6. The developer storage case as claimed in claim 1, wherein the discharge opening is defined by a discharge opening forming portion that has a flat surface which is connected to a flow-in opening of an image forming apparatus.

7. The developer storage case as claimed in claim 1, further comprising;

a waste developer storage case that defines a opening formed opposed to the opening of the storage case, a handle fix portion that is formed on the waste developer storage case, the handle fix portion rotatably supporting a handle, wherein said another end side support member divides the storage case and the waste developer storage case, and a concave portion is formed on the waste developer storage case, the concave portion allowing an user to push a back surface of the handle fix portion.

8. The developer storage case as claimed in claim 1, wherein the developer storage case includes only one delivery member rotating in the developer storage case.

9. An image forming apparatus comprising:

an image holder;

a developing device that develops a latent image on the surface of the image holder into a visible image;

the developer storage case according to claim 1, the developer storage case storing therein a new developer to be supplied to the developing device;

a transfer device that transfers the visible image developed by the developing device to a medium; and a fixing device that fixes the visible image transferred to the medium.

* * * * *